US009595154B2

(12) United States Patent
Takada et al.

(10) Patent No.: US 9,595,154 B2
(45) Date of Patent: Mar. 14, 2017

(54) MEDIUM PROCESSING DEVICE AND MEDIUM TRANSACTION DEVICE

(71) Applicant: Oki Electric Industry Co., Ltd., Tokyo (JP)

(72) Inventors: Masaki Takada, Tokyo (JP); Atsushi Takada, Tokyo (JP); Satoru Iwasaki, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/111,352

(22) PCT Filed: Nov. 10, 2014

(86) PCT No.: PCT/JP2014/079774
§ 371 (c)(1),
(2) Date: Jul. 13, 2016

(87) PCT Pub. No.: WO2015/118742
PCT Pub. Date: Aug. 13, 2015

(65) Prior Publication Data

US 2016/0335829 A1 Nov. 17, 2016

(30) Foreign Application Priority Data

Feb. 4, 2014 (JP) ..... 2014-019551

(51) Int. Cl.
*G07F 7/04* (2006.01)
*G07D 11/00* (2006.01)
*B65H 29/00* (2006.01)

(52) U.S. Cl.
CPC ..... *G07D 11/0081* (2013.01); *B65H 29/006* (2013.01); *B65H 2301/4191* (2013.01);
(Continued)

(58) Field of Classification Search
CPC ..... G07D 11/021; G07D 13/00; G07F 7/04; B65H 39/00; B65H 2301/41; B65H 2301/43
See application file for complete search history.

(56) References Cited

U.S. PATENT DOCUMENTS 8,833,537 B2 9/2014 Kashiwabuchi et al.
2003/0116400 A1* 6/2003 Saltsov ..... B65H 29/006 194/207

FOREIGN PATENT DOCUMENTS

JP 2008-123093 A 5/2008
JP 2009-146240 A 7/2009
JP 2013-025707 A 2/2013

* cited by examiner

*Primary Examiner* — Mark Beauchaine
(74) *Attorney, Agent, or Firm* — Rabin & Berdo, P.C.

(57) ABSTRACT

A medium processing device including: a main tape having one end fixed to a drum, and being wound onto the drum while sandwiching a medium with the drum; a first roller at which the main tape unwound from a main reel is turned back at a distant location from the drum; a second roller at which the main tape, turned back by the first roller and travelled along the drum, is separated from the drum and turned back toward the drum, the medium being sandwiched between portions of the main tape turned back by the first and second rollers and being conveyed between the second roller and the drum; an auxiliary tape having one end fixed to a location of the drum that does not overlap with the main tape, and winding the medium onto the drum at least within a separation range of the main tape from the drum.

8 Claims, 14 Drawing Sheets

(52) U.S. Cl.
CPC ..... *B65H 2301/41912* (2013.01); *B65H 2701/1912* (2013.01)

MEDIUM PROCESSING DEVICE AND MEDIUM TRANSACTION DEVICE

TECHNICAL FIELD

The present application claims the benefit of priority of Japanese Patent Application No. 2014-019551, filed in Japan on Feb. 4, 2014, and the disclosures thereof are incorporated herein by reference in their entirety.

The present invention relates to a medium processing device and a medium transaction device, and is suitably applied to, for example, an automatic teller machine (ATM) in which mediums such as banknotes or the like are inserted by customers and desired transactions are carried out.

BACKGROUND ART

Heretofore, ATMs and the like that are used in financial institutions and the like and in which, in accordance with the details of a transaction with a customer, cash—for example, banknotes and coins or the like—is deposited by the customer or cash is withdrawn by the customer, have been becoming widespread.

An ATM has been proposed that includes: a banknote deposit and withdrawal aperture for transferring banknotes to and from, for example, customers; a verification section that verifies the denominations of deposited banknotes and whether the banknotes are authentic; a temporary holding section that temporarily retains the deposited banknotes; and banknote cassettes that store the banknotes of the respective denominations.

In a deposit transaction, when a customer deposits banknotes in the banknote deposit and withdrawal aperture, this ATM verifies the deposited banknotes at the verification section, and stores banknotes that are verified as being normal in the temporary holding section. Meanwhile, banknotes that are verified as not being suitable for the transaction are returned to the banknote deposit and withdrawal aperture and returned to the customer. Then, when the customer has verified a deposit amount, the ATM feeds out the banknotes stored in the temporary holding section, re-verifies the denominations of the banknotes at the verification section, and stores the banknotes in the banknote cassettes in accordance with the verified denominations.

The temporary holding section is, for example, a section that includes a cylindrical drum that rotates, a long tape of which one end is fixed at a peripheral surface of the drum, a reel around which the tape is wound, and plural rollers and the like that cause the tape to travel along a predetermined travel path. The temporary holding section stores banknotes by winding the banknotes onto the peripheral surface of the drum together with the tape, and peels the banknotes from the peripheral surface and feeds out the banknotes (for example, see FIG. 1 in Japanese Patent Application Laid-Open (JP-A) No. 2009-146240).

For example, as illustrated in FIG. 14 and FIG. 15, in a conventional temporary holding section 615, a tape 632 that is unwound from a reel 631 is caused to travel forward by a roller 33, is turned back to rearward by a first roller 34, is advanced toward a peripheral surface 21S of a drum 21, and is turned around approximately three quarters of the circumference of the peripheral surface 21S. Hence, the tape 632 is temporarily separated from the peripheral surface 21S, is turned back by a second roller 37, is again advanced toward the peripheral surface 21S, and is finally wound onto the peripheral surface. In this temporary holding section 615, a banknote BL is conveyed and wound onto the peripheral surface 21S with the short sides of the banknote BL being set along the advance direction and the circumferential direction.

When the temporary holding section 615 is storing banknotes BL, the drum 21 is turned in a predetermined direction while the banknotes BL are sandwiched and conveyed between a first conveyance region 632A of the tape 632, which is turned back toward the peripheral surface 21S of the drum 21 by the first roller 34, and a second conveyance region 632B, which is turned back again toward the peripheral surface 21S by the second roller 37. Hence, the banknotes BL are successively wound onto the peripheral surface 21S of the drum 21 so as to be pressed against the peripheral surface 21S by the tape 632.

SUMMARY OF INVENTION

Technical Problem

However, in the temporary holding section 615 with this structure, a banknote BL is pressed against the peripheral surface 21S of the drum 21 by the tape 632 only at a central vicinity of the length direction of the banknote BL. Consequently, in the temporary holding section 615, two end portions of the long side direction of the banknote BL that is wound onto the peripheral surface 21S of the drum 21 may lift up from the peripheral surface 21S. If this happens in the temporary holding section 615, the two end portions that have lifted up from the peripheral surface 21S may come into contact with other portions of the interior of the temporary holding section 615 as the drum 21 turns, which may lead to a deterioration in the winding condition of the banknote BL onto the peripheral surface 21S. Accordingly, there may be a conveyance failure during feeding out or the like. Or, there may be damage, jamming or the like of the banknote BL.

Furthermore, in the temporary holding section 615 as shown in FIG. 15, the banknote BL may not be pressed against the peripheral surface 21S in a separation range E1 in which the tape 632 is temporarily separated from the peripheral surface 21S of the drum 21 by the second roller 37. Therefore, in the temporary holding section 615, particularly if the length of the short sides of the banknote BL is relatively short, the banknote BL is not completely pressed on by the tape 632 and may fall from the peripheral surface 21S.

Thus, in the conventional temporary holding section 615, it is possible that banknotes BL may not always be securely wound onto the peripheral surface 21S of the drum 21.

The present invention has been made in consideration of the problem described above; a medium processing device and a medium transaction device that may wind sheet-form mediums onto a peripheral surface of a drum reliably are proposed.

Solution to Problem

To solve the problem, a medium processing device according to a first aspect of the present invention includes: a drum that is configured to be rotatable, and that has a peripheral surface on which a sheet-form medium is wound; a main tape that has one length direction end that is fixed to the peripheral surface, the main tape being wound onto the drum in conjunction with rotation of the drum while sandwiching the medium between the main tape and the peripheral surface; a main reel that takes up the main tape; a first roller at which the main tape, having been unwound from the main reel, is turned back at a location that is distant from the drum, the first roller causing the main tape to be in proximity to the peripheral surface; a second roller at which the main tape, having been turned back by the first roller and having travelled along the peripheral surface, is separated from the peripheral surface and turned back toward the peripheral surface once more, the medium being sandwiched between a portion of the main tape that has been turned back by the second roller and a portion of the main tape that has been turned back by the first roller, and the medium being conveyed between the second roller and the peripheral surface; an auxiliary tape that has one length direction end that is fixed to a location of the peripheral surface that does not overlap with the main tape, the auxiliary tape winding the medium onto the peripheral surface at least within a separation range in which the main tape is separated from the peripheral surface by the second roller; and an auxiliary reel that takes up the auxiliary tape.

A medium transaction device according to a second aspect of the present invention includes: a receiving section that receives a sheet-form medium, for which a transaction is to be performed, from outside the medium transaction device; a conveyance section that conveys the medium; and the medium processing device according to the first aspect.

In the present aspects described above, after a medium has been wound onto the peripheral surface of the drum by the main tape, when the main tape is temporarily separated from the peripheral surface of the drum in the separation range and cannot press the medium against the peripheral surface, the medium may be pressed against the drum by the auxiliary tape and the wound state of the medium may be maintained.

Effects of Invention

According to the present aspects, when the main tape is temporarily separated from the peripheral surface of the drum in the separation range, the mediums may be pressed against the drum by the auxiliary tape. Thus, according to the present aspects, a medium processing device and a medium transaction device that may wind sheet-form mediums onto the peripheral surface of the drum reliably may be realized.

DESCRIPTION OF EMBODIMENTS

Herebelow, embodiments are described using the attached drawings.

1. First Embodiment

—1-1. Overall Structure of ATM—

Figure 1:
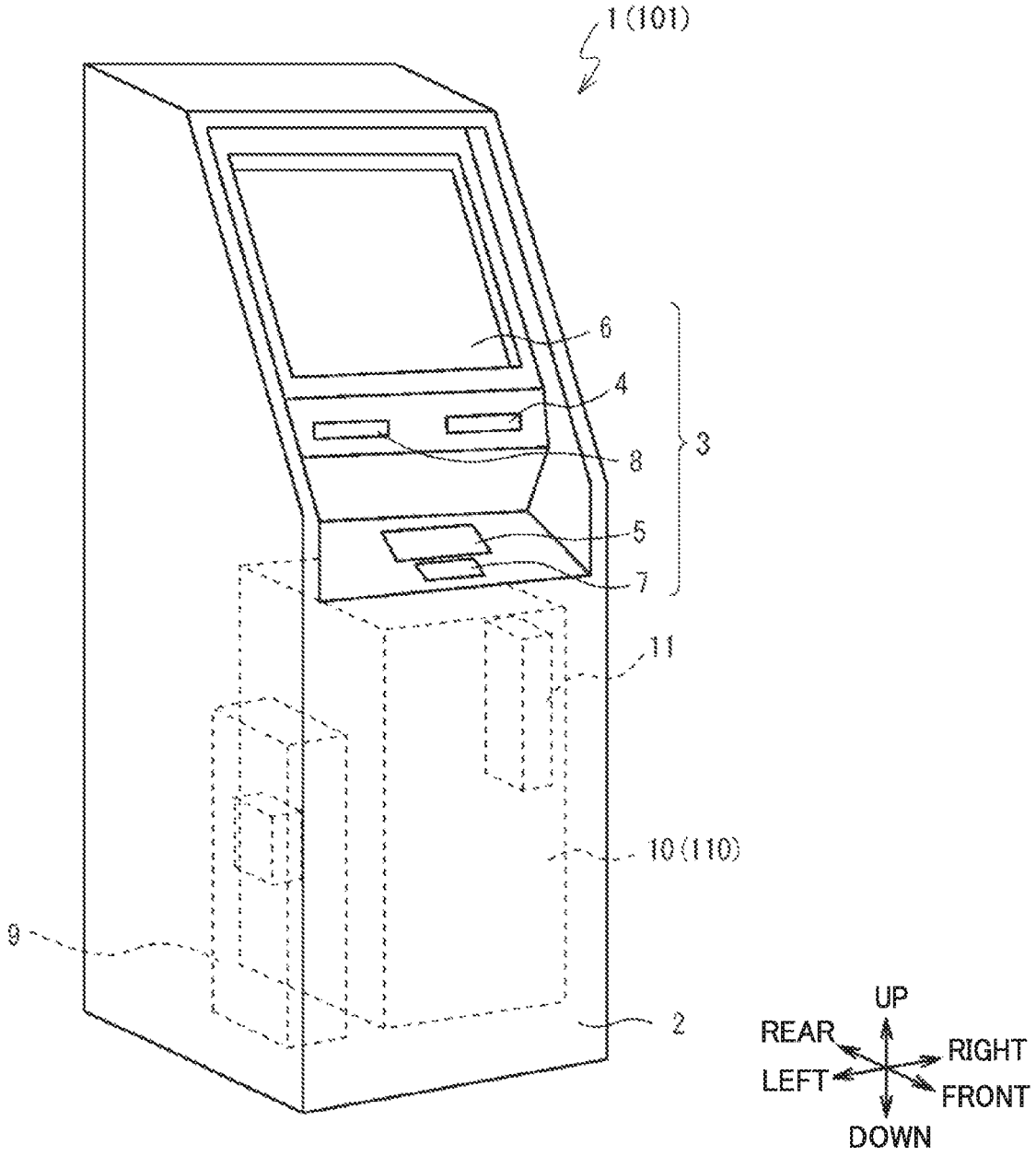
FIG. 1 is a schematic perspective view showing structures of an ATM.

As shown by the exterior view in FIG. 1, an ATM 1 is basically structured by a box-shaped casing 2. The ATM 1 is placed in, for example, a financial institution or the like and conducts transactions relating to cash with customers, such as deposit transactions, withdrawal transactions and so forth. Herebelow, descriptions are given with the side of the ATM 1 that a customer faces being defined as the front side, the opposite side being defined as the rear side, the left and right as viewed by a customer facing the front side being defined as the left side and the right side, and the upper side and the lower side being defined thus.

The casing 2 has a shape in which a front side thereof is recessed at an angle at a location at which a customer standing in front of the casing 2 may easily insert banknotes, operate the ATM 1 through a touchscreen and the like; that is, this location is a region extending from an upper portion of the front face of the casing 2 to an upper face of the casing 2. A customer interface section 3 is provided at this region. The customer interface section 3 is configured so as to directly give and receive cash, bank books and the like to and from customers, and to give information about transactions and receive operational instructions. The customer interface section 3 is provided with a card insertion and ejection aperture 4, a banknote deposit and withdrawal aperture 5, an operation and display section 6, a ten-key pad 7 and a receipt issue aperture 8.

The card insertion and ejection aperture 4 is a portion at which various cards such as cash cards and the like are inserted and ejected. A card processing section (not shown in the drawings) is disposed behind the card insertion and ejection aperture 4. The card processing section reads account numbers that are magnetically recorded on the various cards, and the like. The banknote deposit and withdrawal aperture 5 is a portion at which customers insert banknotes to be deposited and at which banknotes BL being withdrawn by customers are ejected. The banknote deposit and withdrawal aperture 5 is opened and closed by driving of a shutter.

The operation and display section 6 is formed of a touch panel in which a liquid crystal display (LCD) that displays operation screens during transactions, and touch sensors are integrated. Various transaction selections, PIN numbers, transaction amounts and the like are entered through the touch sensors. The ten-key pad 7 includes physical keys that accept entries of the digits 0 to 9 and the like. The ten-key pad 7 is used during entry operations for PIN numbers, transaction amounts and the like. The receipt issue aperture 8 is a region at which receipts on which transaction details and the like are printed are issued when transaction processing has been completed. A receipt processing section (which is not shown in the drawings) that prints transaction details and the like on the receipts is disposed behind the receipt issue aperture 8.

A main control section 9, a banknote deposit and withdrawal apparatus 10 and the like are disposed inside the casing 2. The main control section 9 supervises and controls the ATM 1 as a whole. The banknote deposit and withdrawal apparatus 10 performs various processes on the banknotes.

The main control section 9 is structured around a central processing unit (CPU), which is not shown in the drawings. The main control section 9 reads a predetermined program from a ROM, flash memory or the like, which is not shown in the drawings, and executes the program to carry out various processes such as deposit transactions, withdrawal transactions and the like. The main control section 9 includes a memory section therein, which is a random access memory (RAM), a hard disc drive, flash memory or the like. Various kinds of information are memorized in this memory section.

Figure 2:
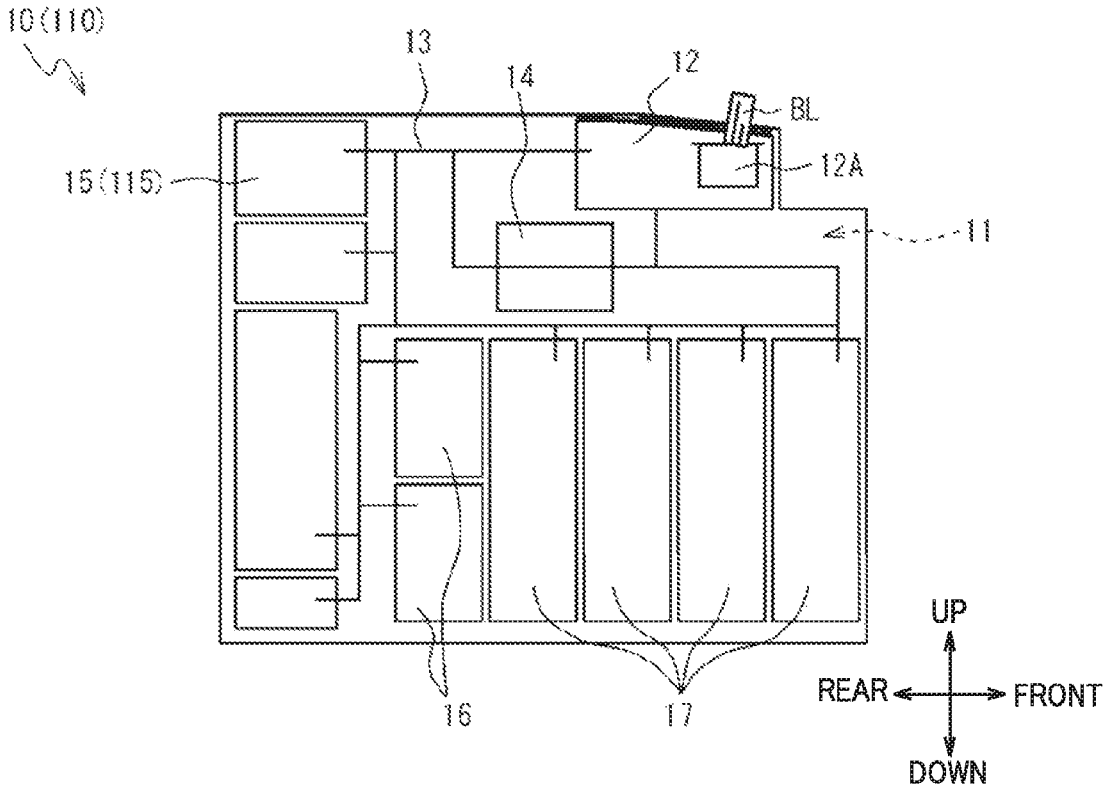
FIG. 2 is a schematic diagram showing structures of a banknote deposit and withdrawal apparatus.

As shown in a side view in FIG. 2, plural sections that apply various processes to banknotes BL are incorporated inside the banknote deposit and withdrawal apparatus 10. The respective sections of the banknote deposit and withdrawal apparatus 10 are controlled by a banknote control section 11.

Similarly to the main control section 9, the banknote control section 11 is structured around a central processing unit (CPU), which is not shown in the drawings. The banknote control section 11 reads a predetermined program from a ROM, flash memory or the like, which is not shown in the drawings, and executes the program to carry out various processes, such as processing to determine conveyance destinations of banknotes and the like. The banknote control section 11 also includes a memory section therein, which is a RAM, flash memory or the like. Various kinds of information are memorized in this memory section.

For example, when a customer is performing a deposit transaction to deposit banknotes, after receiving a predetermined operation command via the operation and display section 6, the banknote control section 11 opens the shutter of the banknote deposit and withdrawal aperture 5 and causes banknotes to be inserted into a deposit and withdrawal section 12. After the banknotes are inserted into a container 12A of the deposit and withdrawal section 12, the deposit and withdrawal section 12 closes the shutter of the banknote deposit and withdrawal aperture 5, extracts the banknotes from the container 12A one at a time, and transfers the banknotes to a conveyance section 13. The conveyance section 13 advances the banknotes, which are formed in rectangular sheet shapes, in the direction of short sides thereof and conveys the banknotes to a verification section 14.

The verification section 14, while conveying banknotes therein, uses optical components, magnetic sensing components and the like to verify the denominations and authenticity of the banknotes, and levels of damage and the like. The verification section 14 reports the verification results to the banknote control section 11. In response, the banknote control section 11 determines conveyance destinations of the banknotes in accordance with the acquired verification results. The conveyance section 13 conveys banknotes that are verified as being normal banknotes by the verification section 14 to a temporary holding section 15 or the like and the banknotes are temporarily retained therein. Meanwhile, the conveyance section 13 conveys reject banknotes that should not be used in a transaction to the deposit and withdrawal section 12 and returns them to the customer.

Thereafter, via the operation and display section 6, the banknote control section 11 prompts the customer to confirm the deposited amount. The banknotes held at the temporary holding section 15 are conveyed to the verification section 14 by the conveyance section 13, and the denominations, levels of damage and the like are verified again, and verification results are acquired. If the level of damage to a banknote is great, the banknote control section 11 determines that this banknote should not be re-used, and the banknote is conveyed to a reject cassette 16 by the conveyance section 13 and stored. If the level of damage to a banknote is slight, the banknote control section 11 determines that the banknote should be re-used, and the banknote is conveyed by the conveyance section 13 and stored in a banknote cassette 17 corresponding to the denomination of the banknote.

In a case in which the banknote control section 11 receives a command from a customer to cancel a deposit transaction, the banknote control section 11 successively feeds out all the banknotes BL held in the temporary holding section 15, conveys the banknotes BL to the deposit and withdrawal section 12 with the conveyance section 13, and returns the banknotes BL to the customer.

Thus, the banknote deposit and withdrawal apparatus 10 conveys banknotes inserted by a customer for a deposit transaction to the temporary holding section 15, temporarily retains the banknotes at the temporary holding section 15, subsequently feeds out the banknotes from the temporary holding section 15, and conveys the banknotes and stores the banknotes in the banknote cassette 17 or the like.

—1-2. Structure of Temporary Holding Section—

Figure 3A:
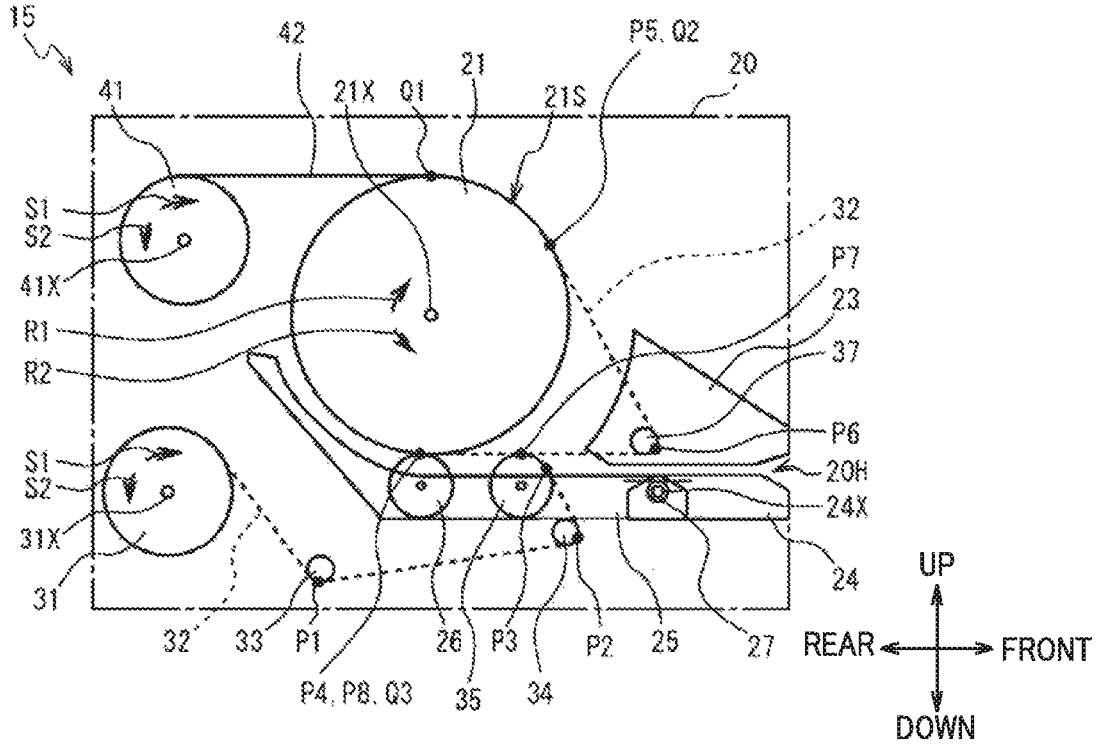
FIG. 3A is a schematic diagram showing structures of a temporary holding section in accordance with the first embodiment.

As shown in FIG. 3A, the temporary holding section 15 is a structure in which the outer side is covered by a frame 20 (shown by single-dot chain lines in the drawings) and respective components are mounted therein. Although FIG. 3A schematically shows a left side view of the temporary holding section 15, some components are made transparent or omitted for convenience of description.

—1-2-1. Structures of Drum and Guides—

A cylindrical drum 21 is disposed at a central vicinity of the interior of the frame 20. A central axis of the drum 21 is oriented in the left-and-right direction. The drum 21 is turned in a winding direction R1 and an unwinding direction R2 about a turning axle 21X along the left-and-right direction, by driving force from a motor, which is not shown in the drawings, being transmitted to the drum 21. The turning axle 21X is supported by a support member, which is not shown in the drawings, to be turnable relative to the frame 20.

Figure 3B:
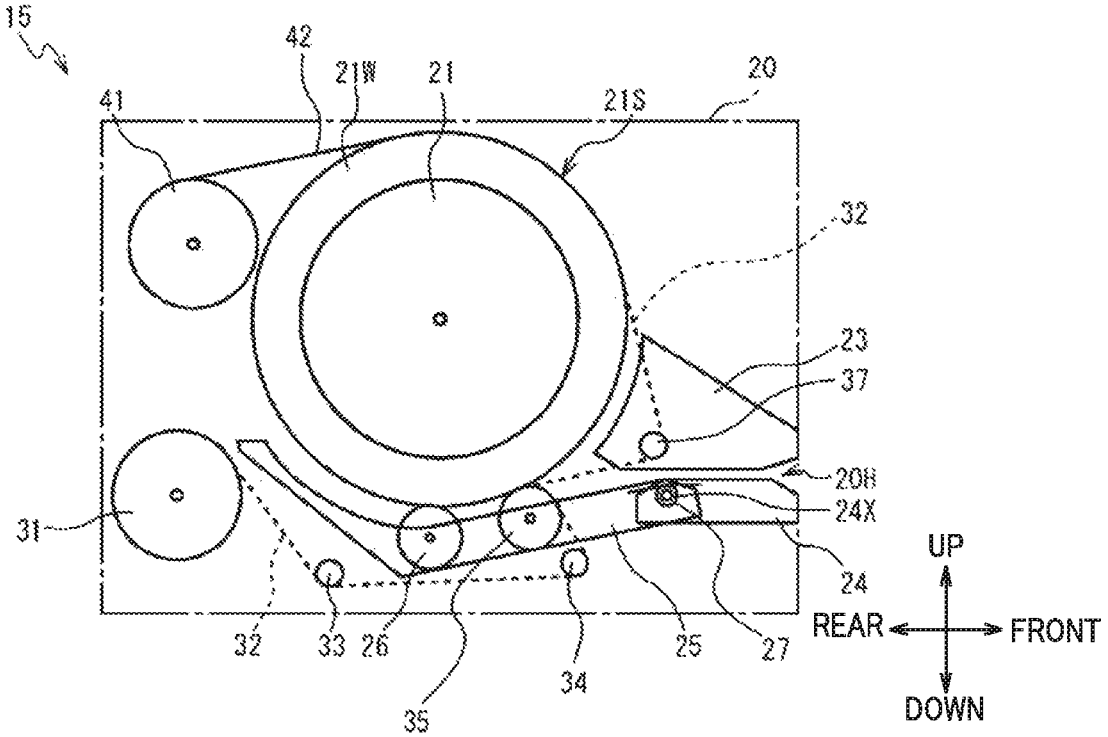
FIG. 3B is a schematic diagram showing structures of the temporary holding section in accordance with the first embodiment.

When banknotes BL are wound onto the peripheral surface 21S, as described below, a winding layer 21W is formed at the drum 21 as shown in FIG. 3B. An effective radius of the drum 21 at this time is larger than in a state in which no banknotes BL are wound on (FIG. 3A). In other words, the peripheral surface 21S is disposed further to the diametric direction outer side of the drum 21.

An insertion hole 20H is formed in a front side face of the frame 20 for insertion of banknotes BL. An upper guide 23 and a lower guide 24 that respectively guide the banknotes BL from above and below are provided behind the insertion hole 20H.

A lower face of the upper guide 23 is formed to be substantially flat and substantially horizontal, and is fixed at the frame 20. An upper face of the lower guide 24 is formed to be substantially flat and substantially horizontal, and is fixed at the frame 20 so as to form a gap of, for example, around 5 mm from the lower face of the upper guide 23. According to this structure, the temporary holding section 15 may guide banknotes BL in the front-and-rear direction along the gap between the upper guide 23 and the lower guide 24. The upper guide 23 and the lower guide 24 are both constituted of transparent resin material. Therefore, visibility of the banknotes BL, a main tape 32 that is described below and the like is improved.

A movable guide 25 is provided at the rear of the lower guide 24, so as to be disposed substantially directly below the drum 21. The movable guide 25 serves as a medium guide and is formed by molding of a transparent resin material. A front half portion of the movable guide 25 is formed in a flat planar shape so as to extend from the upper face of the lower guide 24. A rear half portion of the movable guide 25 is inclined as a whole so as to rise toward the rear thereof. An upper face of the rear half portion of the movable guide 25 forms a curved surface that is recessed such that the upper face protrudes downward, that is, such that the upper face corresponds with the peripheral surface 21S of the drum 21. The rear half portion of the movable guide 25 is formed to be relatively long, reaching to a location only slightly lower than the turning axle 21X of the drum 21.

A drum-abutting roller 26 is disposed at a location of the upper face of the movable guide 25 that is substantially directly below the drum 21. The drum-abutting roller 26 is in a small cylindrical shape whose central axis is oriented in the left-and-right direction. The drum-abutting roller 26 is supported at the movable guide 25 so as to be freely turnable about the central axis thereof. A portion of the upper side of the drum-abutting roller 26 is exposed above the movable guide 25 and other portions of the drum-abutting roller 26 are embedded within the movable guide 25.

A front end portion of the movable guide 25 is turnably supported, via a turning axle 24X, at a rear end portion of the lower guide 24. The movable guide 25 is urged upward, that is, toward the peripheral surface 21S of the drum 21, by a spring 27, which is a torsion spring.

Therefore, even as a winding amount of banknotes BL on the peripheral surface 21S of the drum 21 changes, the movable guide 25 is turned about the turning axle 24X by the action of the spring 27. Thus, as shown in, for example, FIG. 3A and FIG. 3B, the drum-abutting roller 26 may be abutted against the peripheral surface 21S of the drum 21 at all times. That is, the turning axle 24X and the spring 27 may function as an alteration unit that alters the position and tilt of the movable guide 25. Consequently, the upper face of a rear end portion of the movable guide 25 may be kept at a location that is slightly separated from the peripheral surface 21S.

—1-2-2. Travel System and Travel Path of Main Tape—

A main reel 31 is provided at the lower rear side of the drum 21, substantially centrally in the left-and-right direction. The main reel 31 is formed in a bobbin shape, a turning axle 31X of which is oriented in the left-and-right direction. The main reel 31 is formed with a length in the left-and-right direction that is significantly shorter than that of the drum 21. The main reel 31 is turned in an unwinding direction 51 and a winding direction S2 about the turning axle 31X by driving force from a motor, which is not shown in the drawings, or force applied from externally being transmitted to the main reel 31. The turning axle 31X is supported to be turnable relative to the frame 20 by a support member which is not shown in the drawings.

The main tape 32 is taken up onto the main reel 31. The main tape 32 is formed of, for example, a relatively soft resin material in a long, narrow thin-film shape. A width (length in the left-and-right direction) of the main tape 32 is slightly shorter than the width of the main reel 31, and is significantly shorter than the length of the drum 21 in the left-and-right direction. One end of the main tape 32 is fixed to a peripheral surface of the main reel 31.

A roller 33 is disposed to the lower front of the main reel 31, and is turnably supported by the frame 20. A first roller 34 is disposed further to the front of the roller 33, and is turnably supported by the movable guide 25 at a location at the lower side of the movable guide 25. The roller 33 and the first roller 34 are both formed in cylindrical shapes whose central axes are oriented in the left-and-right direction, and are formed with lengths in the left-and-right direction that are significantly shorter than the drum 21.

A feed roller 35 is disposed to the upper rear of the first roller 34, to the front relative to the drum-abutting roller 26, and is turnably supported by the movable guide 25 and serves as a proximity portion. Similarly to the drum-abutting roller 26, the feed roller 35, which serves as a proximity portion, is in a small cylindrical shape whose central axis is oriented in the left-and-right direction, and is turnably supported by the movable guide 25. Similarly to the drum-abutting roller 26, the feed roller 35 is disposed such that a portion of the upper side thereof is exposed above the movable guide 25 and other portions are embedded within the movable guide 25.

A hole portion is formed in the movable guide 25 to the front of the feed roller 35. The hole portion penetrates through the movable guide 25 in the up-and-down direction and exposes the feed roller 35, from an upper surface to a front surface thereof. The length of this hole portion in the left-and-right direction is longer (i.e., wider) than the width of the main tape 32.

A second roller 37 is provided inside the upper guide 23, and is turnably supported by the upper guide 23. Similarly to the first roller 34, the second roller 37 is formed in a cylindrical shape whose central axis is oriented in the left-and-right direction. A cavity is formed around the second roller 37 inside the upper guide 23, which is wider than the length of the main tape 32 in the left-and-right direction. The cavity communicates with cavities at outer sides of the upper guide 23, upward and rearward of the second roller 37, thus forming a hole portion that penetrates through the upper side and the rear side of the upper guide 23.

The lengths in the left-and-right direction of the drum-abutting roller 26, the roller 33, the first roller 34, the feed roller 35 and the second roller 37 are all slightly longer than the length in the left-and-right direction (that is, the tape width) of the main tape 32.

In this temporary holding section 15, the main tape 32 that has been taken up onto the main reel 31 is unwound downward from the front side of the peripheral surface of the main reel 31, is guided along a predetermined travel path within the temporary holding section 15, and subsequently reaches the peripheral surface 21S of the drum 21.

Specifically, when the main tape 32 is pulled out from the main reel 31, as shown by the broken lines in FIG. 3A and FIG. 3B, the advance direction of the main tape 32 is first switched so as to be directed upward and forward from a point P1 located on the peripheral surface of the roller 33. Then, the main tape 32 is turned back at a point P2 located on the peripheral surface of the first roller 34 so as to be directed upward and rearward. Then, the main tape 32 is directed rearward from a point P3 located on an upper front surface of the feed roller 35, is pressed against the peripheral surface 21S of the drum 21 at a point P4 located at the upper side of the drum-abutting roller 26, and abuts against the peripheral surface 21S.

The main tape 32 passes halfway round the rear side of the drum 21 along the peripheral surface 21S and reaches the top of the drum 21. Then, as illustrated in the schematic perspective view in FIG. 4, the main tape 32 is temporarily separated from the peripheral surface 21S at a point P5 that is advanced forward by between about an eighth and a quarter of the circumference of the peripheral surface 21S, and is directed downward and forward toward the second roller 37. Then, the main tape 32 is turned back to rearward at a point P6 located on the peripheral surface of the second roller 37, and is gently curved by the feed roller 35 at a point P7. The main tape 32 is pressed against and again abutted against the peripheral surface 21S by the drum-abutting roller 26 at a point P8, and is finally taken up onto the drum 21. The distal end of the main tape 32 is fixed to the peripheral surface 21S of the drum 21 in a central vicinity thereof in the left-and-right direction.

In the temporary holding section 15, when the drum 21 is turned in the winding direction R1 (FIG. 3A), the main tape 32 is pulled by the drum 21, travels along the travel path described above, and is finally taken up onto the peripheral surface 21S. On the other hand, when the main reel 31 of the temporary holding section 15 is turned in the winding direction S2 (FIG. 3A) and the drum 21 is turned in the unwinding direction R2, the main tape 32 is peeled from the peripheral surface 21S of the drum 21, advances in the opposite direction along the travel path described above, and is finally taken up onto the main reel 31. Therefore, tension acts on the main tape 32 at all points on the travel path.

For convenience of description, the main reel 31, the main tape 32, the roller 33, the first roller 34, the feed roller 35, the drum-abutting roller 26 and the second roller 37 are below collectively referred to as a "main tape travel system 30". As shown by the portions thereof in FIG. 4, the respective components of the main tape travel system 30 are all disposed substantially centrally in the left-and-right direction in the temporary holding section 15.

—1-2-3. Structure and Travel Path of Auxiliary Tapes—

In addition to those structures, as shown in FIG. 3A and FIG. 3B, respective auxiliary reels 41 are provided at two left and right locations to the upper rear side of the drum 21, that is, to the upper side of the main reel 31. Similarly to the main reel 31, each auxiliary reel 41 is formed in a bobbin shape with a turning axle 41X oriented in the left-and-right direction, and the length thereof in the left-and-right direction is significantly shorter than that of the drum 21. Also similarly to the main reel 31, each auxiliary reel 41 turns in an unwinding direction 51 and a winding direction S2 about the turning axle 41X, by driving force being transmitted from a motor which is not shown in the drawings. Each turning axle 41X is supported to be turnable relative to the frame 20 by a support member that is not shown in the drawings.

Respective auxiliary tapes 42 are wound round the auxiliary reels 41. Similarly to the main tape 32, each auxiliary tape 42 is formed of a relatively soft resin material in a long, narrow thin-film shape. The width of the auxiliary tape 42 is slightly shorter than the width of the auxiliary reel 41 and is significantly shorter than the length of the drum 21 in the left-and-right direction. One end of the auxiliary tape 42 is fixed to the peripheral surface of the respective auxiliary reel 41.

Each auxiliary tape 42 is unwound forward from the upper end of the auxiliary reel 41, abuts against the peripheral surface 21S of the drum 21 at a point Q1 in the vicinity of the upper end of the drum 21, and is simply taken up onto the drum 21 from point Q1. After the auxiliary tape 42 has passed point Q1, the auxiliary tape 42 sequentially passes through points Q2 and Q3, which are disposed to both left and right of the points P5 and P8 of the main tape 32.

Figure 4:
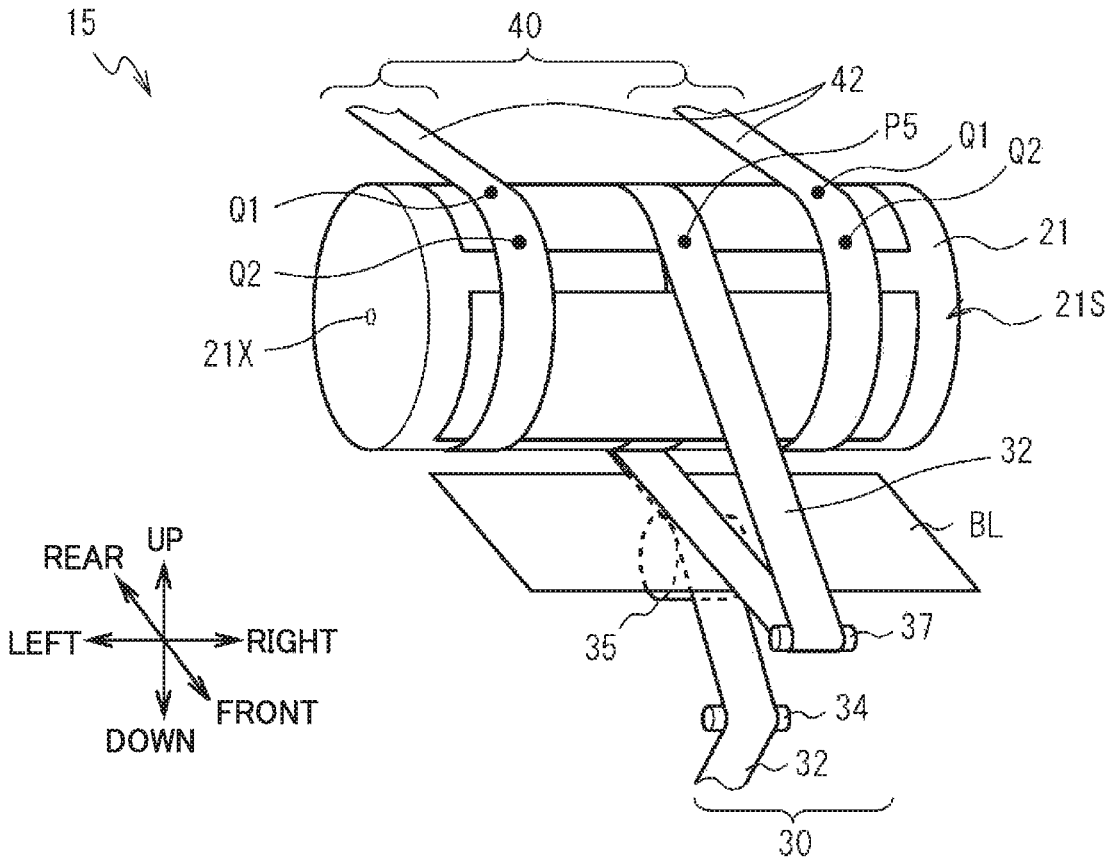
FIG. 4 is a schematic perspective view showing structures of the temporary holding section in accordance with the first embodiment.

Respective distal ends of the two auxiliary tapes 42 are fixed to locations of the peripheral surface 21S of the drum 21 that are separated to left and right from the main tape 32. Therefore, as shown in FIG. 4, the auxiliary tapes 42 are taken up onto the peripheral surface 21S of the drum 21 at locations to both the left and right sides of the main tape 32 that do not overlap with the main tape 32.

For convenience of description, the auxiliary reels 41 and auxiliary tapes 42 are below referred to as "auxiliary tape travel systems 40". The respective components of the auxiliary tape travel systems 40 are disposed at locations that do not overlap in the left-and-right direction with the components of the main tape travel system 30.

—1-3. Operation and Effects—

In the structure described above, the main tape travel system 30 of the temporary holding section 15 according to the first embodiment is disposed at the middle in the left-and-right direction, such that the main tape 32 is wound onto a left-and-right middle region of the peripheral surface 21S of the drum 21. The two auxiliary tape travel systems 40 of the temporary holding section 15 are disposed at locations that are a little distant to each of left and right from the main tape travel system 30, such that the auxiliary tapes 42 are wound onto both the left and right sides of the peripheral surface 21S of the drum 21.

Figure 5:
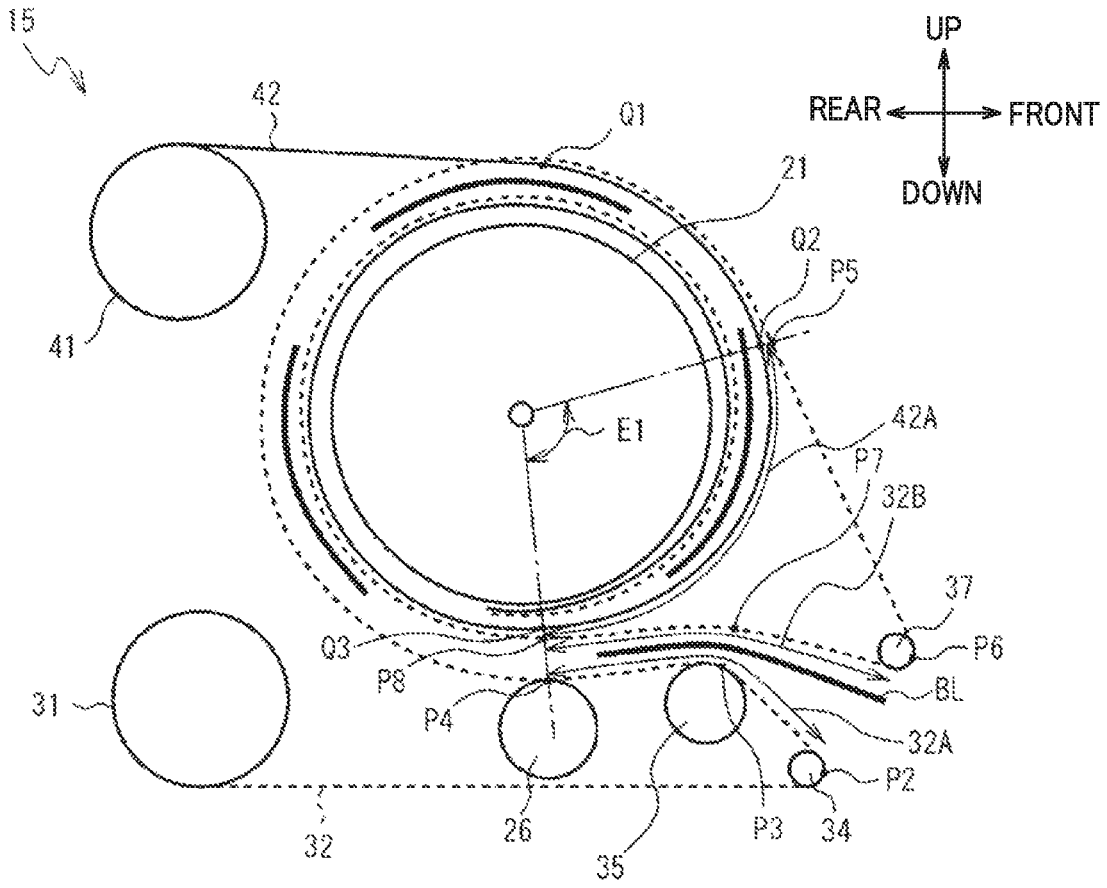
FIG. 5 is a schematic diagram showing travel paths of tapes in accordance with the first embodiment.

The travel paths of the main tape 32 and auxiliary tapes 42 of the temporary holding section 15 may be depicted as in FIG. 5, by being shown schematically and partially simplified. In FIG. 5, the travel path of the main tape 32 is shown by a broken line and the travel path of each auxiliary tape 42 is shown by a solid line. In FIG. 5, for convenience of description, gaps between the tapes are widened, positions thereof are intentionally offset, and some of the components of the temporary holding section 15 are omitted from the drawing.

In FIG. 5, a portion of the main tape 32 from where the main tape 32 turns back at point P2 on the first roller 34 until the main tape 32 comes into contact with the peripheral surface 21S of the drum 21 at point P4 (which portion is below referred to as a "first travel portion 32A") and a portion of the main tape 32 from where the main tape 32 turns back at point P6 on the second roller 37 until the main tape 32 comes into contact with the peripheral surface 21S of the drum 21 at point P8 (which portion is below referred to as a "second travel portion 32B") oppose one another.

The first travel portion 32A and second travel portion 32B are separated from one another at front ends thereof, because the first roller 34 and the second roller 37 are at positions that are distant from one another. In contrast, because the rear end of the first travel portion 32A is pressed against the peripheral surface 21S of the drum 21 by the drum-abutting roller 26, the rear end of the first travel portion 32A is pressed against the second travel portion 32B that is disposed at the upper side thereof.

The first travel portion 32A is lifted upward by the feed roller 35 at point P3, which is in a central vicinity in the front-and-rear direction, and pushes up the second travel portion 32B at point P7. Consequently, a rear half portion of the first travel portion 32A (that is, a portion from point P3 to point P4) presses against a rear half portion of the second travel portion 32B (that is, a portion from point P7 to point P8). Thus, the rear half portion of the first travel portion 32A and the rear half portion of the second travel portion 32B are in a state of very close proximity or abutting.

In the temporary holding section 15 according to this structure, when a banknote BL is conveyed rearward along the gap between the upper guide 23 and the lower guide 24, the drum 21 is turned in the winding direction R1, causing the main tape 32 to travel. As a result, the banknote BL is nipped from above and below by the rear half portions of the first travel portion 32A and the second travel portion 32B, and may be conveyed rearward. Then, with the turning of the drum 21, the temporary holding section 15 may wind the banknote BL and two perimeter lengths of the main tape 32 nipping the banknote BL from above and below onto the peripheral surface 21S in the same nipped state.

That is, after the main tape travel system 30 of the temporary holding section 15 has abutted the main tape 32 against the peripheral surface 21S of the drum 21 and wound for some amount, the main tape 32 is temporarily separated from the drum 21 before again being abutted against the peripheral surface 21S. Therefore, when the temporary holding section 15 is winding the banknote BL onto the peripheral surface 21S, the respective portions of the main tape 32 that are adjacent to and wound onto the inner peripheral side and the outer peripheral side of the banknote BL have been abutted against the banknote BL from the preceding conveyance stage and may be wound on with the abutting state being maintained. Therefore, there is no need in the temporary holding section 15 for the banknote BL to be handed over from other components or the like just before the banknote BL is wound onto the peripheral surface 21S of the drum 21, and incidences of jamming or the like associated with handovers may be avoided.

Regardless of an amount of the banknotes BL wound onto the peripheral surface 21S, the movable guide 25 (FIG. 3A and FIG. 3B) causes the drum-abutting roller 26 to abut against the peripheral surface 21S. Therefore, the upper face of the drum-abutting roller 26 is disposed along the travel path of the main tape 32. Therefore, the temporary holding section 15 may guide banknotes BL nipped by the first travel portion 32A and second travel portion 32B of the main tape 32 or banknotes BL that have been wound onto the peripheral surface 21S with the upper face of the movable guide 25, and may prevent folding of the banknotes BL, lifting of the banknotes BL from the peripheral surface 21S and the like.

The drum-abutting roller 26 does not abut against the peripheral surface 21S of the drum 21 or the banknotes BL wound onto the peripheral surface 21S; the drum-abutting roller 26 abuts against a rear end vicinity of the first travel portion 32A of the main tape 32. That is, in the temporary holding section 15, the drum-abutting roller 26 does not directly abut against the banknotes BL that are being conveyed or that have been wound onto the peripheral surface 21S and are turning. Therefore, incidences of damage or jamming of the banknotes BL due to a banknote BL being caught on the drum-abutting roller 26 may be fundamentally eliminated.

Now the auxiliary tapes 42 are considered. The auxiliary tapes 42 are wound onto the peripheral surface 21S of the drum 21 from point Q1 in the vicinity of the top of the peripheral surface 21S, and press each banknote BL against the peripheral surface 21S at vicinities of each of left and right end portions of the banknote BL. Therefore, in the temporary holding section 15, both the left and right end portions of the banknote BL are pressed against the peripheral surface 21S and lifting of the two end portions of the banknote BL from the peripheral surface 21S may be reliably prevented.

As described above, because the main tape 32 is temporarily separated from the peripheral surface 21S in the range from point PS to point P8 (below referred to as a separation range E1), the main tape 32 cannot press a banknote BL against the peripheral surface 21S in this range. In particular, when the length of a banknote BL in the circumferential direction, which is the length of the short sides of the banknote BL, is relatively short, a range of the banknote BL that is pressed against the peripheral surface 21S by the main tape 32 in the separation range E1 is small. Thus, mispositioning of the banknote BL may occur or the banknote BL may not be completely pressed against the peripheral surface 21S and may peel off from the peripheral surface 21S.

However, because the auxiliary tapes 42 are maintained in the state of being wound onto the peripheral surface 21S in the region from point Q2 to point Q3 corresponding to the separation range E1 (hereinafter referred to as a "first auxiliary region 42A"), a banknote BL may be continuously pressed against the peripheral surface 21S regardless of the length of the short sides of the banknote BL.

In the temporary holding section 15, the auxiliary tapes 42 abut against the outer peripheral side of a banknote BL at point Q1, and the auxiliary tapes 42 wind the banknote BL onto the peripheral surface 21S while maintaining the abutting state of the auxiliary tapes 42 against the banknote BL. Therefore, in the temporary holding section 15, a deterioration in the winding condition due to the banknote BL catching on a roller or the like or an incidence of jamming of or damage to the banknote BL or suchlike, which could occur in a structure in which banknotes BL were pressed against the peripheral surface 21S in the separation region E1 by rollers or the like, may be avoided.

Figure 6:
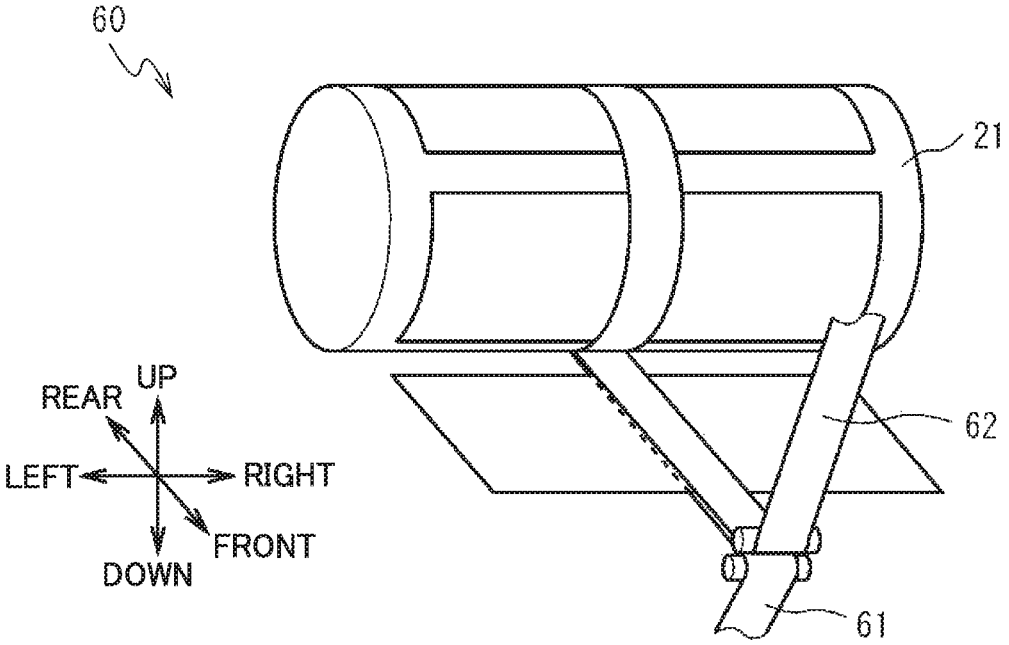
FIG. 6 is a schematic perspective view showing structures of a temporary holding section in accordance with a conventional alternative mode.

Now, as illustrated in FIG. 6, which corresponds to FIG. 4, a structure that is known as a conventional temporary holding section 60 is provided with two tapes 61 and 62. A banknote BL is nipped from both sides by the two tapes 61 and 62, and is wound onto the peripheral surface 21S of the drum 21 with this nipped state being maintained.

However, in this temporary holding section 60, both of the tapes 61 and 62 are superposed and wound on for each turn of winding of banknotes BL onto the peripheral surface 21S. That is, two perimeter lengths of the tapes are superposed and wound on for each perimeter of winding of the banknotes BL. As a result, the effective radius of the drum 21 in the temporary holding section 60 becomes very large, particularly when a large number of banknotes BL are wound on, and it is necessary to reserve a relatively large space for the drum 21 within the frame 20 (FIG. 3A and FIG. 3B).

In contrast, in the temporary holding section 15 according to the present embodiment (FIG. 3A to FIG. 5), it is sufficient to wind on only one perimeter length of the main tape 32 for each perimeter of winding of the banknotes BL, without superposition with another tape, and only one perimeter length of each auxiliary tape 42 is wound on, at positions that do not overlap with the main tape 32. Therefore, the temporary holding section 15 may keep the effective radius of the drum 21 when a large number of banknotes BL are wound on smaller than in the conventional temporary holding section 60, and a space that must be reserved for the drum 21 inside the frame 20 (FIG. 3A and FIG. 3B) may be kept smaller.

Then, when the temporary holding section 15 is feeding out banknotes BL, the main tape 32 is caused to travel in the opposite direction to the direction during winding by the main reel 31 being turned in the winding direction S2 and the drum 21 being turned in the unwinding direction R2 (FIG. 3A). Thus, the banknotes BL that have been wound onto the peripheral surface 21S of the drum 21 are successively peeled off.

When a banknote BL is being peeled off from the peripheral surface 21S of the temporary holding section 15, the respective portions of the main tape 32 that are superposed with the inner peripheral side and the outer peripheral side of the banknote BL may be conveyed forward while the superposed state is maintained, that is, while the state in which the two faces of the banknote BL are sandwiched between the first travel portion 32A and second travel portion 32B of the main tape 32 (see FIG. 5) is maintained. Therefore, there is no need for the temporary holding section 15 to use a scraper or the like to peel the banknote BL from the peripheral surface 21S of the drum 21, and there is no need to hand over the banknote BL to another conveyance mechanism or the like immediately after the banknote BL has been peeled off. Consequently, incidences of difficulties such as jamming of or damage to the banknotes BL may be avoided.

In the temporary holding section 15, when the auxiliary tapes 42 reach point Q1, only the auxiliary tapes 42 are peeled from the peripheral surface 21S; the state in which the banknotes BL are pressed against the peripheral surface 21S by the main tape 32 is maintained. Thus, there is no obstruction by the auxiliary tapes 42 at point PS and point P8 of the temporary holding section 15; the banknotes BL and the main tape 32 may be smoothly peeled from the peripheral surface 21S.

In the temporary holding section 15 at this time, banknotes BL in an outermost layer are sandwiched by the first travel portion 32A and second travel portion 32B of the main tape 32 and are separated from the peripheral surface 21S. Meanwhile, banknotes BL wound on at the inner peripheral side are wound onto the peripheral surface 21S by the first auxiliary region 42A of each auxiliary tape 42. Therefore, even if attractive forces act between the banknotes BL due to the effects of static electricity or the like, in the temporary holding section 15 the banknotes BL in the outermost layer may be excellently separated from the banknotes BL at the inner peripheral side.

Figure 7:
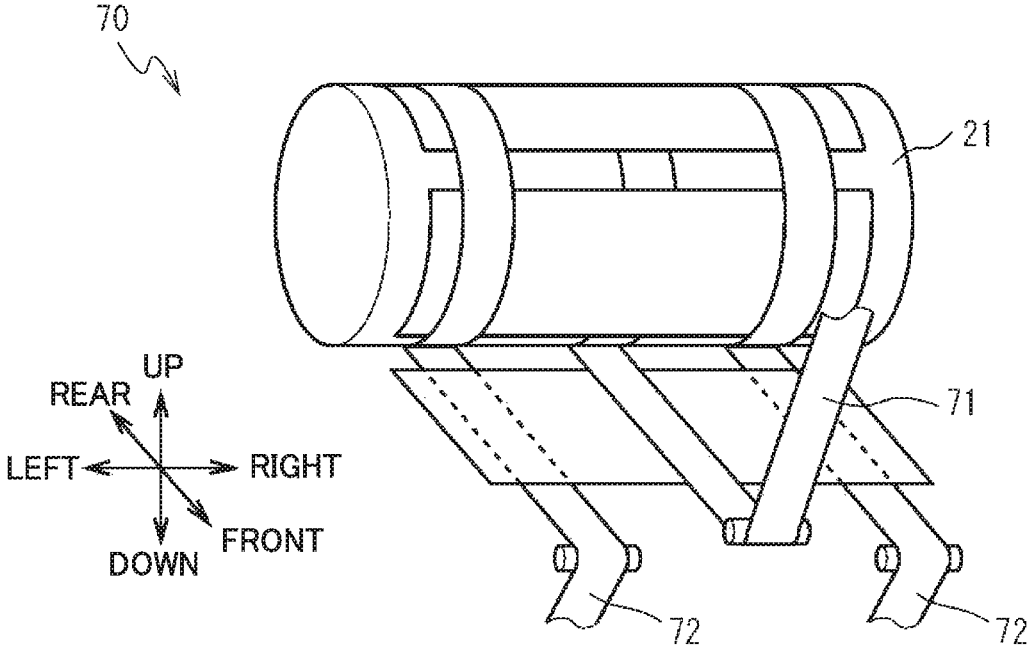
FIG. 7 is a schematic perspective view showing structures of a temporary holding section in accordance with a conventional alternative mode.

As shown in FIG. 7, which corresponds to FIG. 4, a structure has been proposed as a conventional temporary holding section 70 in which a main tape 71 and auxiliary tapes 72 are disposed so as not to overlap in the left-and-right direction, and banknotes BL are nipped in the up-and-down direction and conveyed by the main tape 71 and the auxiliary tapes 72. However, in this temporary holding section 70, particularly in a case of handling banknotes BL of plural types with different lengths in the left-and-right direction (that is, the length direction of the banknotes BL), it may not be possible to nip banknotes BL that are short in the left-and-right direction and these banknotes BL may fall off while being conveyed.

In contrast, in the temporary holding section 15 according to the present embodiment, the banknotes BL are nipped from above and below and conveyed by the main tape 32 that is disposed centrally in the left-and-right direction. Therefore, even banknotes BL whose length in the left-and-right direction is short may be conveyed reliably.

In the temporary holding section 15, the first travel portion 32A (FIG. 5) of the main tape 32 is pressed against the second travel portion 32B at the upper side thereof by the feed roller 35. Therefore, in the temporary holding section 15, a gap between the first travel portion 32A and second travel portion 32B of the main tape 32 may be made narrower and the banknotes BL may be reliably nipped and conveyed.

According to the structure described above, in the temporary holding section 15 according to the first embodiment, the main tape 32 is wound onto the peripheral surface 21S of the drum 21 substantially at the middle in the left-and-right direction, the second travel portion 32B is formed by temporarily separating the main tape 32 with the second roller 37, the banknotes BL are nipped and conveyed between the second travel portion 32B and the first travel portion 32A, and the banknotes BL are wound on in this state. Additionally in the temporary holding section 15, the auxiliary tapes 42 are wound on at both the left and right sides prior to the main tape 32 that has been wound onto the peripheral surface 21S of the drum 21 being separated therefrom. As a result, in the separation range E1 of the temporary holding section 15 in which the main tape 32 is separated from the peripheral surface 21S of the drum 21, the banknotes BL may be pressed against the peripheral surface 21S by the first auxiliary regions 42A of the auxiliary tapes 42.

2. Second Embodiment

An ATM 101 according to the second embodiment (FIG. 1) differs from the ATM 1 according to the first embodiment in including a banknote deposit and withdrawal apparatus 110 instead of the banknote deposit and withdrawal apparatus 10, but has the same structure in other respects. The banknote deposit and withdrawal apparatus 110 (FIG. 2) differs from the banknote deposit and withdrawal apparatus 10 according to the first embodiment in including a temporary holding section 115 instead of the temporary holding section 15, but has the same structure in other respects.

—2-1. Structure of Temporary Holding Section—

Figure 8A:
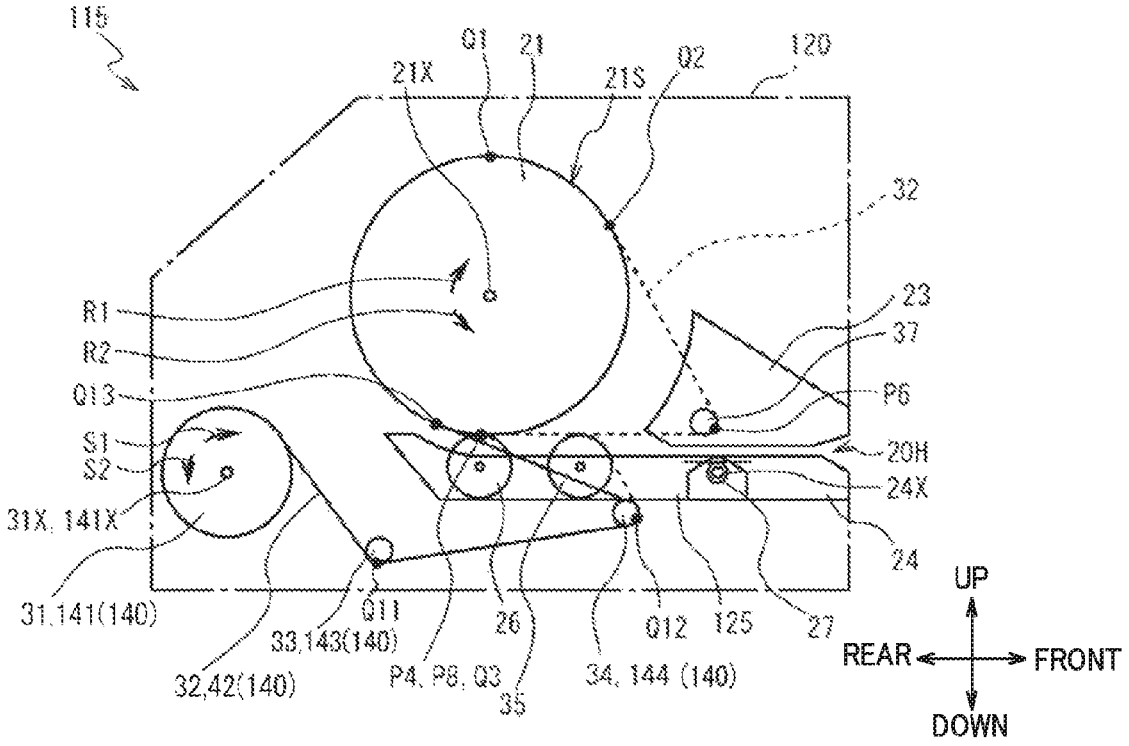
FIG. 8A is a schematic diagram showing structures of a temporary holding section in accordance with a second embodiment.
Figure 8B:
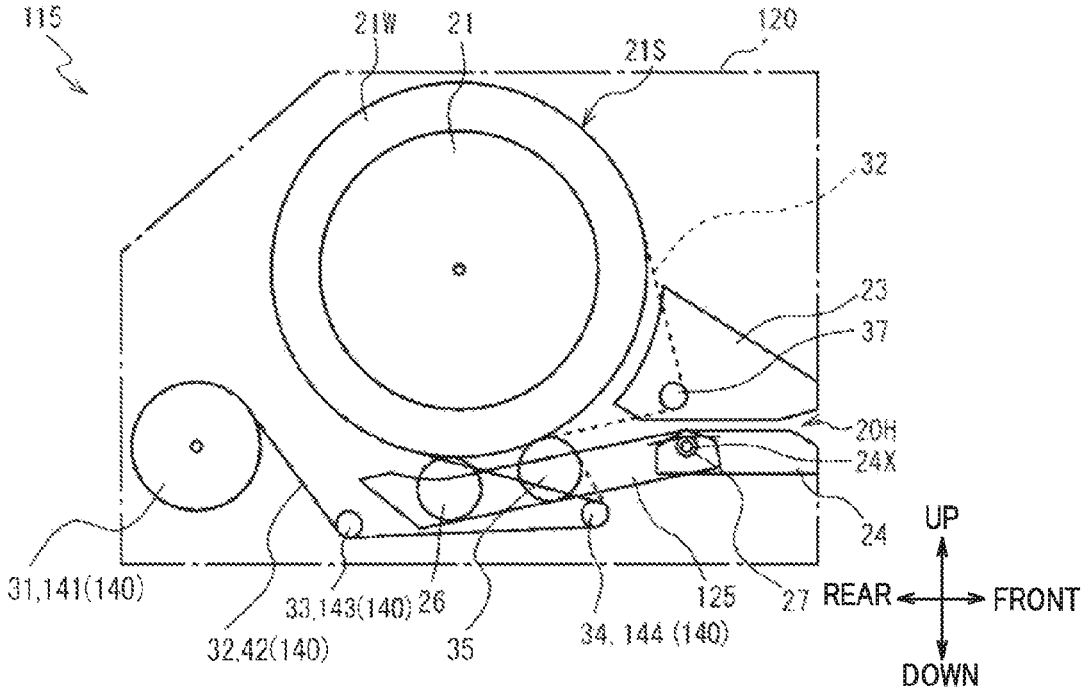
FIG. 8B is a schematic diagram showing structures of the temporary holding section in accordance with the second embodiment.

As shown in FIG. 8A and FIG. 8B, which correspond to FIG. 3A and FIG. 3B respectively, the temporary holding section 115 has a structure in which the components thereof are mounted inside a frame 120, which corresponds to the frame 20.

The drum 21, upper guide 23 and lower guide 24 are provided in the frame 120, similarly to the first embodiment, and a movable guide 125 is also provided in place of the movable guide 25. A front half portion of the movable guide 125 has a similar structure to that of the movable guide 25, but a rear half portion is formed to be shorter than that of the movable guide 25. The main tape travel system 30, which includes the main reel 31, main tape 32, roller 33, first roller 34, feed roller 35, drum-abutting roller 26 and second roller 37, is provided in the temporary holding section 115 similarly to the first embodiment.

In the temporary holding section 115, auxiliary tape travel systems 140 are respectively provided to left and right of the main tape travel system 30 instead of the auxiliary tape travel systems 40 according to the first embodiment. Along with the auxiliary tape 42 with the same structure as in the first embodiment, each auxiliary tape travel system 140 is structured by an auxiliary reel 141 in place of the auxiliary reel 41, a roller 143 and a roller 144.

Each auxiliary reel 141 is formed in a bobbin shape similar to the auxiliary reel 41. A turning axle 141X of the auxiliary reel 141 is disposed on a line of extension of the turning axle 31X of the main reel 31 and is structured as a single shaft that is continuous with the turning axle 31X. The auxiliary tape 42 is taken up onto the auxiliary reel 141 in the same direction as a take-up direction of the main tape 32 onto the main reel 31. The rollers 143 and rollers 144 are disposed below the drum 21 to left and right of the rollers 33 and 34, respectively, and are each freely turnable.

In the temporary holding section 115, each auxiliary tape 42 is unwound downward from the front side of the peripheral surface of the auxiliary reel 141 and guided through the interior of the temporary holding section 115 in the same manner as the main tape 32, and is subsequently wound onto the drum 21.

Specifically, as shown by the solid lines in FIG. 8A and FIG. 8B, the advance direction of the auxiliary tape 42 is first switched so as to be directed upward and forward from a point Q11 located on the peripheral surface of the roller 143. Next, the auxiliary tape 42 is turned back at a point Q12 located on the peripheral surface of the roller 144 so as to be directed upward and rearward. Then, the auxiliary tape 42 abuts against the peripheral surface 21S at a point Q13 and is wound onto the drum 21 and, after passing approximately halfway round the rear side of the drum 21, successively passes through the points Q1, Q2 and Q3 in the same manner as in the first embodiment.

—2-2. Operation and Effects—

In the structure described above, the main tape travel system 30 of the temporary holding section 115 according to the second embodiment is disposed at the middle in the left-and-right direction, as the same as in the first embodiment, such that the main tape 32 is wound onto the left-and-right middle region of the peripheral surface 21S of the drum 21. The auxiliary tape travel systems 140 of the temporary holding section 115, which are different from the first embodiment, are disposed at locations that are a little distant to each of left and right from the main tape travel system 30, such that the auxiliary tapes 42 are wound onto both the left and right sides of the peripheral surface 21S of the drum 21.

Figure 9:
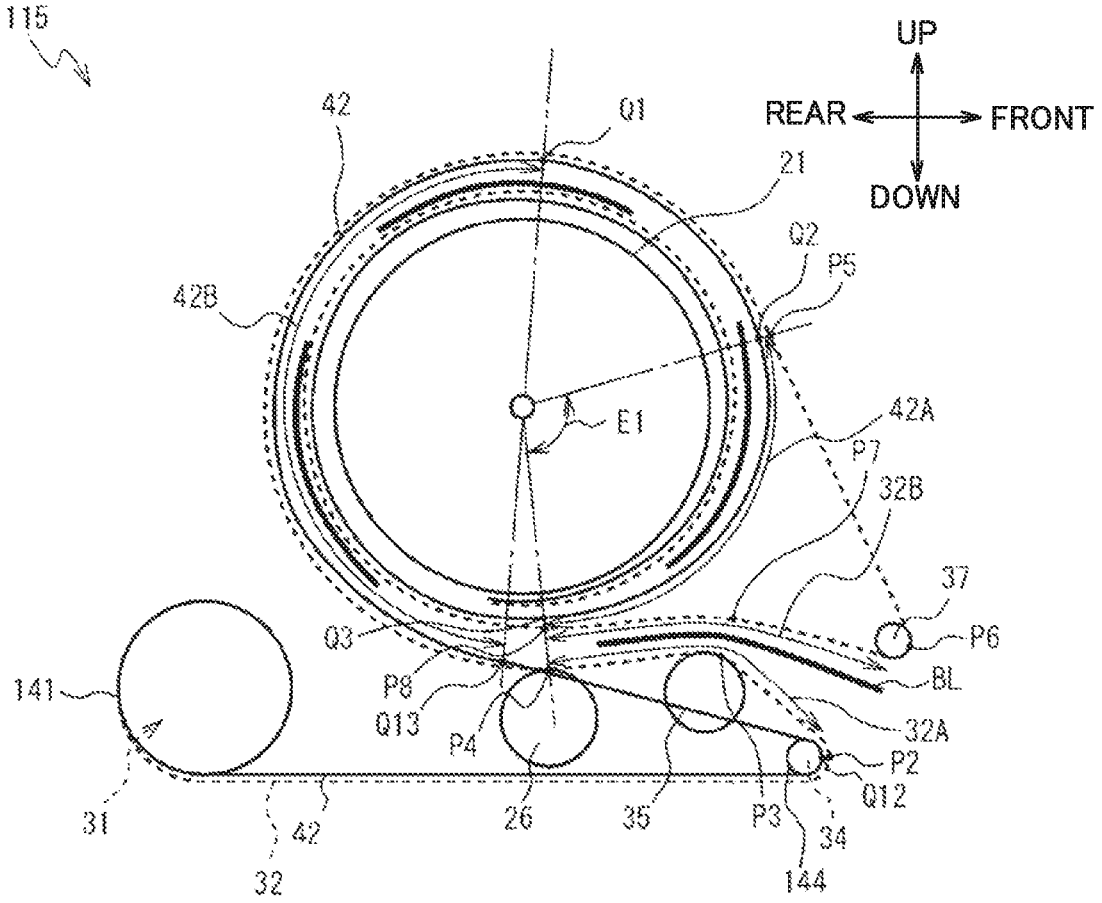
FIG. 9 is a schematic diagram showing travel paths of tapes in accordance with the second embodiment.

The travel paths of the main tape 32 and auxiliary tapes 42 of the temporary holding section 115 may be depicted as in FIG. 9, which corresponds to FIG. 5, by being shown schematically and partially simplified. In FIG. 9, the travel path of the main tape 32 is shown by a broken line and the travel path of each auxiliary tape 42 is shown by a solid line.

In FIG. 9, the main tape 32 passes along the same travel path as in the first embodiment. The region of the first travel portion 32A from point P3 to point P4 and the region of the second travel portion 32B from point P7 to point P8 oppose one another. Therefore, the temporary holding section 115 may convey banknotes BL and wind the banknotes BL onto the peripheral surface 21S of the drum 21 with the main tape 32, and may peel the banknotes BL from the peripheral surface 21S and convey the banknotes BL therefrom, in the same manner as in the first embodiment.

Meanwhile, the auxiliary tapes 42 are wound onto the peripheral surface 21S of the drum 21 from point Q13, which is slightly rearward of the lower end of the peripheral surface 21S, and press the banknotes BL against the peripheral surface 21S at each of left and right end portion vicinities of the banknotes BL. Therefore, in the temporary holding section 115, both the left and right end portions of the banknotes BL are pressed against the peripheral surface 21S by the auxiliary tapes 42 and lifting of the end portions of the banknotes BL from the peripheral surface 21S may be reliably prevented.

Specifically, the auxiliary tapes 42 are maintained in the state of being wound onto the peripheral surface 21S in the region from point Q2 to point Q3 corresponding to the separation range E1 (that is, the first auxiliary region 42A), in the same manner as the auxiliary tapes 42 according to the first embodiment (FIG. 5), and the banknotes BL may be continuously pressed against the peripheral surface 21S.

Moreover, in the temporary holding section 115, the point Q13 at which each auxiliary tape 42 starts to wind onto the peripheral surface 21S is disposed at the rear side of a vicinity of the point P4 at which the main tape 32 starts to wind onto the peripheral surface 21S. That is, in the second embodiment, the location at which the auxiliary tape 42 starts to wind onto the peripheral surface 21S is point Q13, which is advanced by approximately half the circumference from point Q1 of the first embodiment. A portion of the auxiliary tape 42 from point Q13 to point Q1 (below referred to as a "second auxiliary region 42B") presses the banknotes BL against the peripheral surface 21S of the drum 21.

Therefore, in the temporary holding section 115, after a banknote BL has been conveyed to the vicinity of the peripheral surface 21S by the first travel portion 32A and second travel portion 32B of the main tape 32, respective vicinities of the left and right end portions of the banknote BL may be pressed against the peripheral surface 21S by the second auxiliary regions 42B of the auxiliary tapes 42 from immediately after the banknote BL starts to be wound onto the peripheral surface 21S.

As a result, in the temporary holding section 115, a range in which only the left-and-right middle region of a banknote BL is pressed against the peripheral surface 21S of the drum 21 by the main tape 32, which is a range in which vicinities of both the left and right ends of the banknote BL are not pressed against the peripheral surface 21S and may lift up, is kept extremely short. Thus, the banknote BL may reliably be wound onto the peripheral surface 21S.

Correspondingly, the rear half portion of the movable guide 25, which is necessary in the temporary holding section 115 according to the first embodiment (FIG. 3A and FIG. 3B), is almost unnecessary in the temporary holding section 115 (FIG. 8A and FIG. 8B). Therefore, the rear half portion of the movable guide 125 of the temporary holding section 115 may be omitted and, thus, the movable guide 125 may be reduced in size and weight compared to the first embodiment.

In a region of the temporary holding section 115 in which the rear end of the movable guide 125 is in proximity to the peripheral surface 21S of the drum 21, a banknote BL that is wound in the outermost peripheral is pressed against the peripheral surface 21S by both the main tape 32 and the second auxiliary regions 42B of the auxiliary tapes 42. Therefore, in the temporary holding section 115, incidences of damage or the like due to a collision between a banknote BL and the rear end of the movable guide 125, which might occur in a case in which a banknote BL that is wound onto the peripheral surface 21S in the outermost peripheral lifts up, particularly when the drum 21 is being turned in the unwinding direction R2 in order to feed out the banknotes BL, may be avoided.

In the temporary holding section 115, the auxiliary reels 141 are disposed to left and right of the main reel 31, and the turning axles 141X are disposed on the line of extension of the turning axle 31X. Therefore, in the temporary holding section 115, a region to the upper side of the main reel 31 and the auxiliary reels 141, which is to the rear side of the upper portion of the drum 21, may be left empty. Thus, the frame 120 may be reduced in volume and made smaller. Furthermore, because a single turning axle that is long in the left-and-right direction functions as the turning axle 31X and the turning axles 141X in the temporary holding section 115, the number of components may be reduced and structures may be simplified compared to the first embodiment.

In other respects, the temporary holding section 115 according to the second embodiment may realize the same operational effects as the temporary holding section 15 according to the first embodiment.

According to the structure described above, in the temporary holding section 115 according to the second embodiment, the main tape 32 is wound onto the peripheral surface 21S of the drum 21 substantially at the middle in the left-and-right direction, the second travel portion 32B is formed by temporarily separating the main tape 32 with the second roller 37, the banknotes BL are nipped and conveyed between the second travel portion 32B and the first travel portion 32A, and the banknotes BL are wound on in this state. Additionally in the temporary holding section 115, the auxiliary tapes 42 are wound on at both the left and right sides from immediately subsequent to the main tape 32 being wound onto the peripheral surface 21S of the drum 21. As a result, both the left and right end portions of a banknote BL may be restrained by the second auxiliary regions 42B of the auxiliary tapes 42 from immediately after the banknote BL is wound onto the peripheral surface 21S, and the banknote BL may be pressed against the peripheral surface 21S by the first auxiliary regions 42A in the separation range E1.

3. Alternative Embodiments

In the embodiments described above, cases are described in which a winding commencement point at which each auxiliary tape 42 starts to wind onto the peripheral surface 21S of the drum 21 is, in the first embodiment, the point Q1 that is in the upper end vicinity of the drum 21 (FIG. 5) and, in the second embodiment, the point Q13 that is in the lower end vicinity of the drum 21 (FIG. 9).

However, embodiments are not limited thus. The winding commencement point may be at various locations such as, for example, forward or rearward relative to point Q1, rearward or upward relative to point Q13, or the like. In these cases, banknotes BL may be pressed against the peripheral surface 21S by the auxiliary tapes 42 in the separation range E1 by setting the winding commencement point to at least be prior to where the main tape 32 separates from the peripheral surface 21S, that is, at the upper side than point P5. Furthermore, in these cases, conveyance may not be impeded when banknotes BL are being fed out by setting the winding commencement point to at least be subsequent to where the banknotes BL are wound onto the peripheral surface 21S, that is, at the rear side and the upper side than point P4 and point P8.

In the first embodiment described above, a case is described in which the feed roller 35 is disposed at the lower side relative to the first travel portion 32A of the main tape 32 and the feed roller 35 presses the first travel portion 32A against the second travel portion 32B to nip the banknotes BL.

Figure 10:
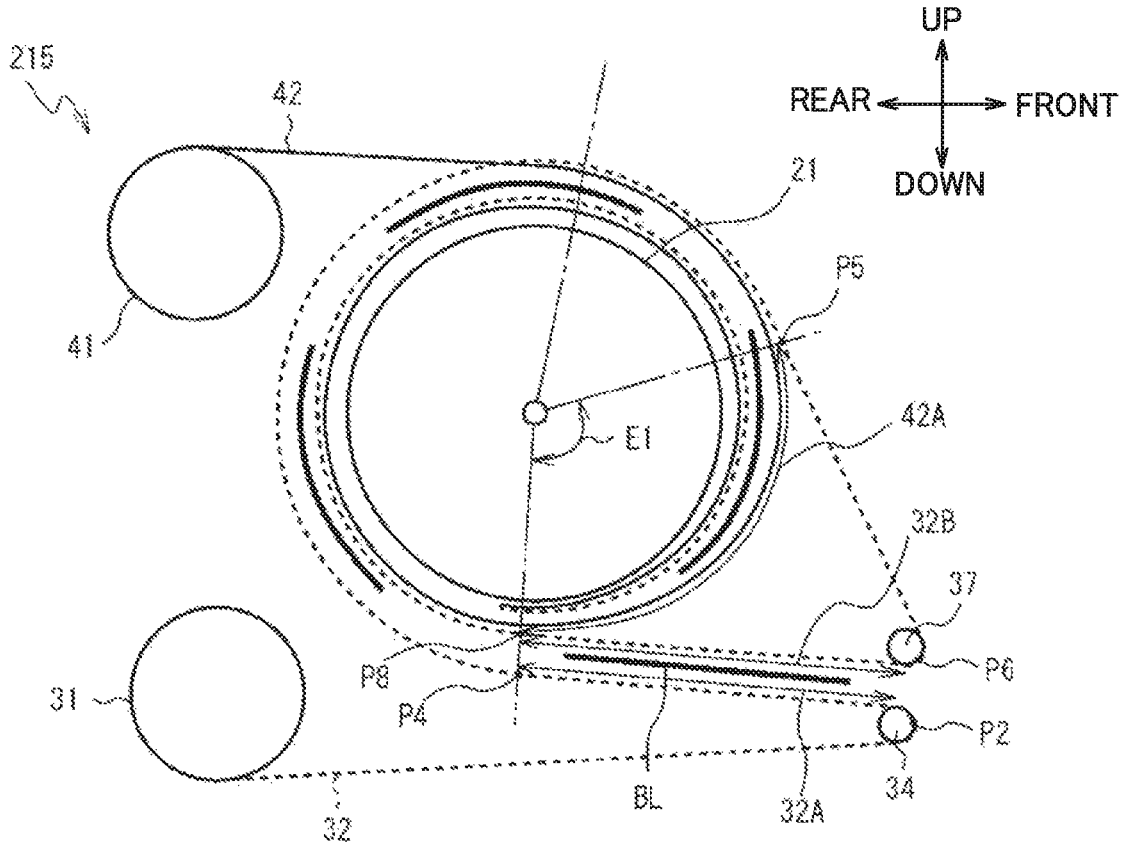
FIG. 10 is a schematic diagram showing travel paths of tapes in accordance with an alternative embodiment.

However, embodiments are not limited thus. For example, the feed roller 35 may be disposed at the upper side relative to the second travel portion 32B of the main tape 32, and the feed roller 35 may press the second travel portion 32B against the first travel portion 32A to nip the banknotes BL. As a further example, as in a temporary holding section 215 shown in FIG. 10, which corresponds to FIG. 5, the feed roller 35 may be omitted, the first roller 34 and the second roller 37 may be disposed in proximity to one another, thus causing the first travel portion 32A and the second travel portion 32B to be in proximity to one another or abutting, and the banknotes BL may be nipped by at least a portion of the first travel portion 32A and the second travel portion 32B. The same is applicable to the second embodiment.

In the first embodiment described above, a case is described in which the single main tape travel system 30 is provided at the substantially left-and-right middle region of the temporary holding section 15 and one each of the auxiliary tape travel system 40 is provided at both the left and right sides (FIG. 4).

Figure 11:
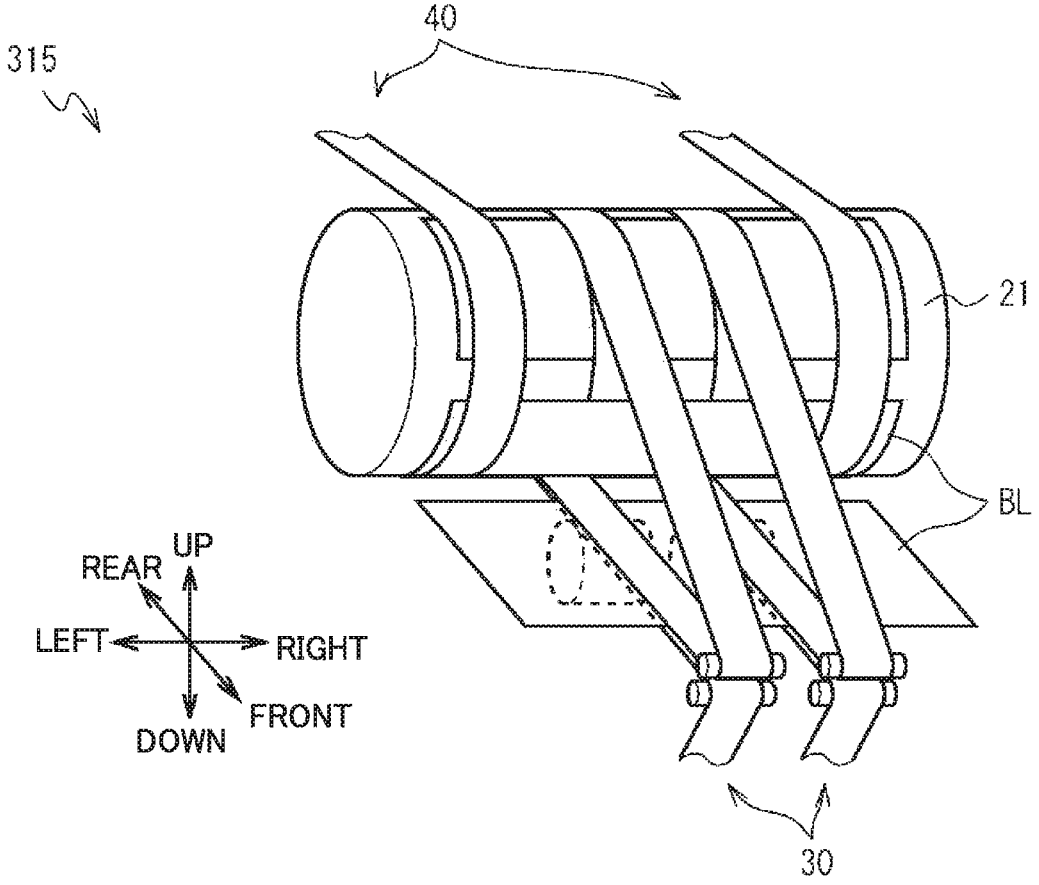
FIG. 11 is a schematic perspective view showing structures of a temporary holding section in accordance with another alternative embodiment.
Figure 12:
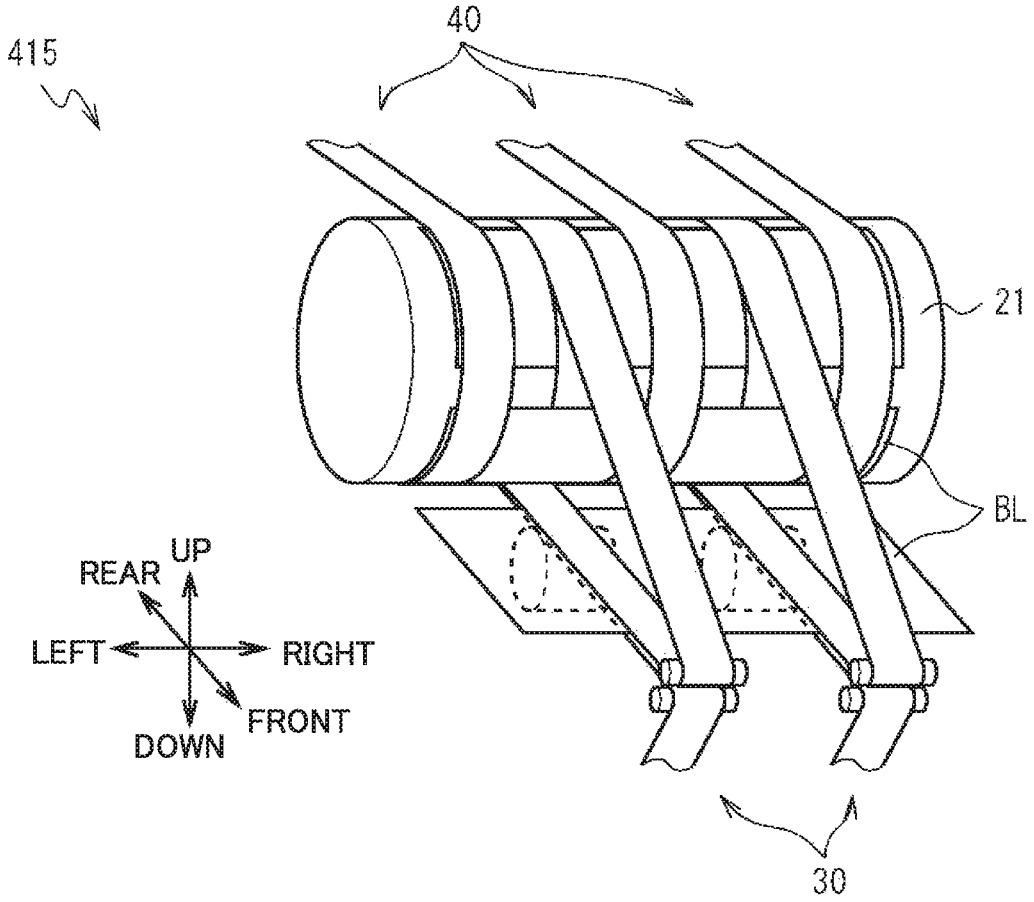
FIG. 12 is a schematic perspective view showing structures of a temporary holding section in accordance with another alternative embodiment.
Figure 13:
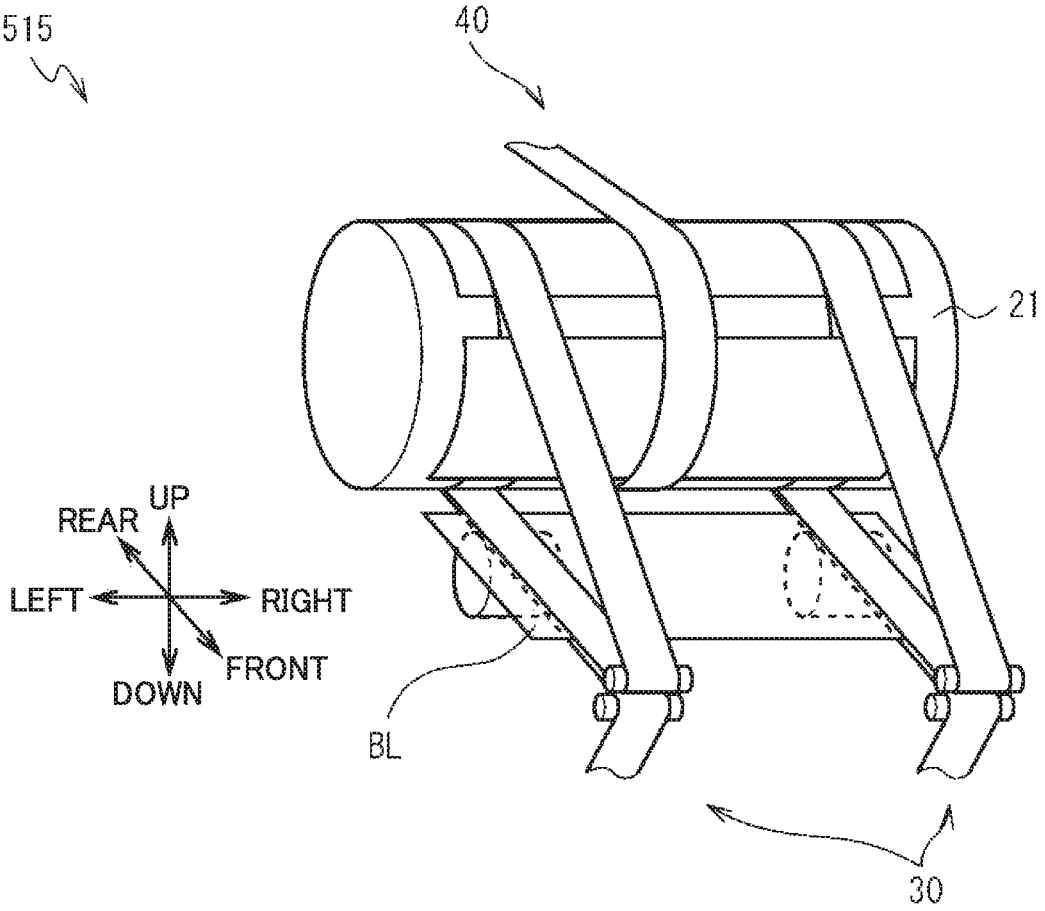
FIG. 13 is a schematic perspective view showing structures of a temporary holding section in accordance with another alternative embodiment.
Figure 14:
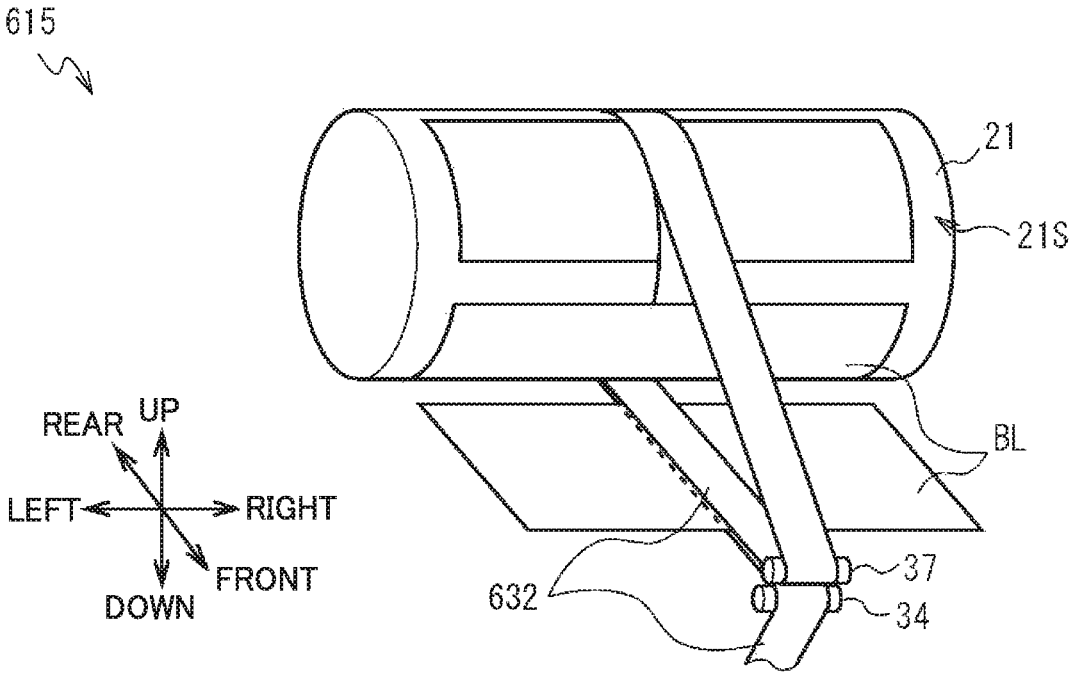
FIG. 14 is a schematic perspective view showing structures of a conventional temporary holding section.
Figure 15:
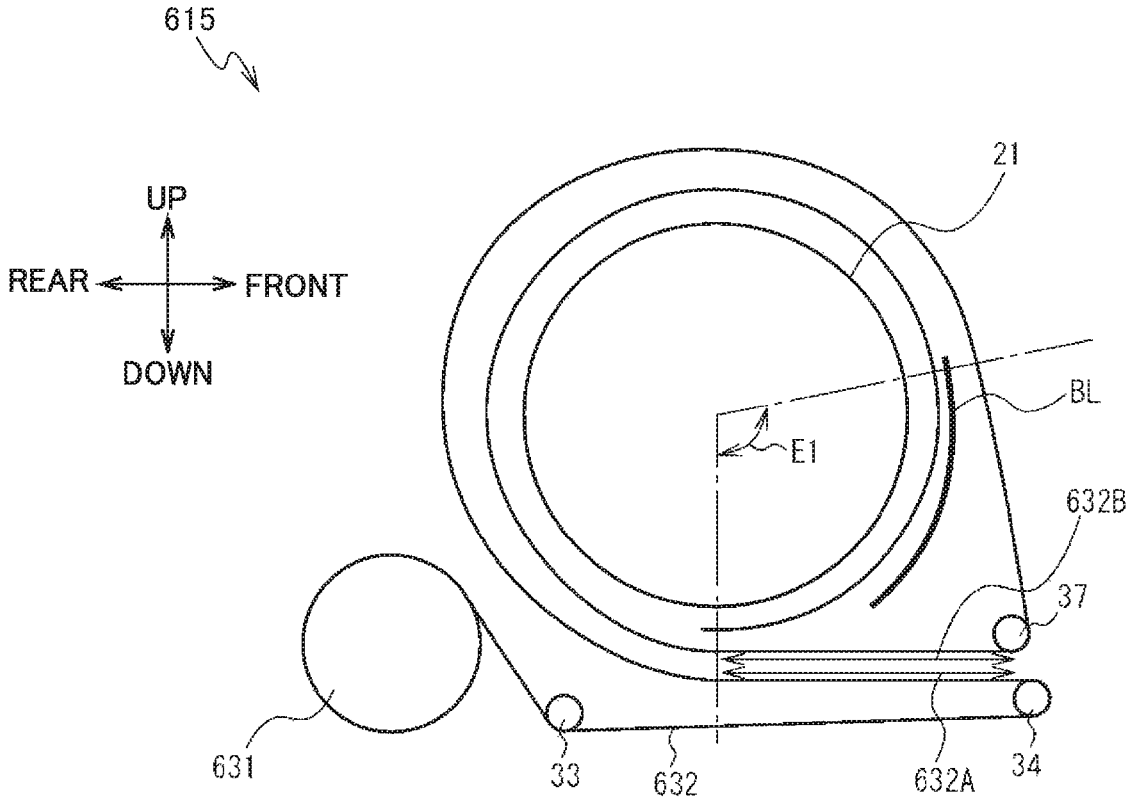
FIG. 15 is a schematic diagram showing structures of the conventional temporary holding section.

However, embodiments are not limited thus. For example, as in a temporary holding section 315 shown in FIG. 11, which corresponds to FIG. 4, two of the main tape travel system 30 may be provided side by side in the vicinity of the left-and-right middle and one each of the auxiliary tape travel system 40 provided at both the left and right sides thereof. Further, as in a temporary holding section 415 shown in FIG. 12, which corresponds to FIG. 4, two of the main tape travel system 30 and three of the auxiliary tape travel system 40 may be provided, arrayed alternatingly in the left-and-right direction. Further, as in a temporary holding section 515 shown in FIG. 13, which corresponds to FIG. 4, two of the main tape travel system 30 may be provided, at each of two left-and-right end vicinities, and one of the auxiliary tape travel system 40 may be provided between the main tape travel systems 30. In other words, one or more of the main tape travel system 30 and one or more of the auxiliary tape travel system 40 may be provided such that a total of three or more of these systems are arrayed in the left-and-right direction. The same is applicable to the second embodiment.

In the second embodiment described above, a case is described in which the winding direction of the main tape 32 at the main reel 31 and the winding direction of the auxiliary tape 42 at each auxiliary reel 141 coincide. However, embodiments are not limited thus. The winding direction of the main tape 32 at the main reel 31 and the winding direction of the auxiliary tape 42 at each auxiliary reel 141 may be opposite to one another.

In the second embodiment described above, a case is described in which each of the main reel 31 and the two auxiliary reels 141 are structured as respectively separate reels. However, embodiments are not limited thus. For example, a single common reel in a long cylindrical shape whose central axis is oriented in the left-and-right direction may be provided in place of the main reel 31 and the two auxiliary reels 141, with the single main tape 32 and the two auxiliary tapes 42 all being taken up onto a peripheral surface of this common reel.

In the first embodiment described above, a case is described in which the tape widths of the main tape 32 and the auxiliary tapes 42 are equal. However, embodiments are not limited thus, and the tape widths of the main tape 32 and the auxiliary tapes 42 may be made different. For example, nipping force on a banknote BL during conveyance may be strengthened and stability may be improved by the tape width of the main tape 32 being made wider. In this case, it is sufficient if the tapes do not overlap with one another when being wound onto the peripheral surface 21S of the drum 21. The same is applicable to the second embodiment.

In the embodiments described above, cases are described in which the banknotes BL are conveyed and wound onto the peripheral surface 21S of the drum 21 with the long sides of the banknotes BL oriented in the left-and-right direction and the short sides oriented in the travel direction or circumferential direction. However, embodiments are not limited thus. For example, the banknotes BL may be conveyed and wound onto the peripheral surface 21S of the drum 21 with the short sides of the banknotes BL oriented in the left-and-right direction and the long sides oriented in the travel direction or circumferential direction. In this case, it is sufficient if the widths of the main tape 32 and the auxiliary tapes 42 are optimized in accordance with the lengths of the short sides of the banknotes BL. The same is applicable to the second embodiment.

In the first embodiment described above, a case is described in which the drum-abutting roller 26 is abutted against the peripheral surface 21S of the drum 21 via the main tape 32. However, embodiments are not limited thus. For example, the drum-abutting roller 26 may be directly abutted against the peripheral surface 21S or the banknotes BL that are being wound on, by a mounting position of the drum-abutting roller 26 being altered in the left-and-right direction relative to the movable guide 25. In the second embodiment, the drum-abutting roller 26 may be abutted against the peripheral surface 21S of the drum 21 via the auxiliary tapes 42.

In the first embodiment described above, a case is described in which the spring 27 is structured by a torsion spring. However, embodiments are not limited thus. Various members that are capable of urging the movable guide 25 against the peripheral surface 21S of the drum 21 may be used in place of the spring 27, such as various springs, resilient bodies and the like. The same is applicable to the second embodiment.

In the first embodiment described above, a case is described in which the movable guide 25 is turned about the turning axle 24X relative to the lower guide 24. However, embodiments are not limited thus. For example, a lower side movable guide in which the lower guide 24 and the movable guide 25 are integrated may be turnably supported by the frame 20, and the upper guide 23 may turn to follow the lower side movable guide or integrally with the lower side guide so as to maintain a gap therebetween. The same is applicable to the second embodiment.

In the first embodiment described above, a case is described in which all of the upper guide 23, the lower guide 24 and the movable guide 25 are constituted of a transparent resin material. However, embodiments are not limited thus, and one, some or all of the guides may be constituted of various materials such as a non-transparent resin material, a metal or the like. The same is applicable to the second embodiment.

In the first embodiment described above, a case is described in which the present invention is applied to the temporary holding section 15 that temporarily holds banknotes deposited by a customer in the banknote deposit and withdrawal apparatus 10 of the ATM 1 that processes transactions relating to the mediums that are banknotes BL with customers. However, embodiments are not limited thus. The first embodiment may be applied to various temporary holding sections that wind mediums onto a drum together with tapes and temporarily hold the mediums, in various devices that handle various sheet-form mediums such as, for example, cache vouchers, security certificates and the like or entry tickets, parking tickets and so forth. The same is applicable to the second embodiment.

In the first embodiment described above, a case is described in which the temporary holding section 15 is structured to serve as a medium processing device by the drum 21 serving as a drum, the main tape 32 serving as a main tape, the main reel 31 serving as a main reel, the first roller 34 serving as a first roller, the second roller 37 serving as a second roller, each auxiliary tape 42 serving as an auxiliary tape, and each auxiliary reel 41 serving as an auxiliary reel.

However, embodiments are not limited thus. The medium processing device may be structured by a drum, main tape, main reel, first roller, second roller, auxiliary tape and auxiliary reel with various alternative structures.

In the first embodiment described above, a case is described in which the ATM 1 is structured to serve as a medium transaction device by the banknote deposit and withdrawal aperture 5 and deposit and withdrawal section 12 serving as a receiving section, the conveyance section 13 serving as a conveyance section, the drum 21 serving as the drum, the main tape 32 serving as the main tape, the main reel 31 serving as the main reel, the first roller 34 serving as the first roller, the second roller 37 serving as the second roller, each auxiliary tape 42 serving as the auxiliary tape, and each auxiliary reel 41 serving as the auxiliary reel.

However, embodiments are not limited thus. The medium transaction device may be structured by a receiving section, conveyance section, drum, main tape, main reel, first roller, second roller, auxiliary tape and auxiliary reel with various alternative structures.

Furthermore, the present invention is not limited to the embodiments and alternative embodiments described above. That is, the present invention encompasses a scope of application that includes embodiments that arbitrarily combine part or the whole of an embodiment described above or an alternative embodiment described above, and embodiments partially derived therefrom.

INDUSTRIAL APPLICABILITY

The present invention is applicable to various devices that wind and temporarily retain sheet-form mediums on a peripheral surface of a drum.

The invention claimed is:

1. A medium processing device, comprising:

a drum that is configured to be rotatable, and that has a peripheral surface on which a sheet-form medium is wound;

a main tape that has one length direction end that is fixed to the peripheral surface, the main tape being wound onto the drum in conjunction with rotation of the drum while sandwiching the medium between the main tape and the peripheral surface;

a main reel that takes up the main tape;

a first roller at which the main tape, having been unwound from the main reel, is turned back at a location that is distant from the drum, the first roller causing the main tape to be in proximity to the peripheral surface;

a second roller at which the main tape, having been turned back by the first roller and having travelled along the peripheral surface, is separated from the peripheral surface and turned back toward the peripheral surface once more, the medium being sandwiched between a portion of the main tape that has been turned back by the second roller and a portion of the main tape that has been turned back by the first roller, and the medium being conveyed between the second roller and the peripheral surface;

an auxiliary tape that has one length direction end that is fixed to a location of the peripheral surface that does not overlap with the main tape, the auxiliary tape winding the medium onto the peripheral surface at least within a separation range in which the main tape is separated from the peripheral surface by the second roller; and an auxiliary reel that takes up the auxiliary tape.

2. The medium processing device according to claim 1, wherein the auxiliary tape winds the medium onto the peripheral surface along with the main tape in at least a portion of a range from where the portion of the main tape that has been turned back by the first roller is wound onto the peripheral surface to where the main tape is separated from the peripheral surface by the second roller.

3. The medium processing device according to claim 2, wherein a rotation axis of the auxiliary reel is disposed on a line of extension of a turning axis of the main reel.

4. The medium processing device according to claim 3, wherein the main reel and the auxiliary reel rotate in the same direction relative to the rotation axes when the respective reels are taking up the main tape and the auxiliary tape.

5. The medium processing device according to claim 1, further comprising a proximity portion that causes a first conveyance portion of the main tape, which is a portion of the main tape from being turned back at the first roller until reaching the peripheral surface, to be in proximity to a second conveyance portion of the main tape, which is a portion of the main tape from being turned back at the second roller until reaching the peripheral surface.

6. The medium processing device according to claim 1, further comprising:

a medium guide that opposes the peripheral surface of the drum and guides the medium such that the medium travels along the peripheral surface or a travel path of the main tape;

an alteration unit that alters the medium guide in accordance with a winding amount of the medium on the peripheral surface; and a drum-abutting roller that is provided at the medium guide and abuts against the peripheral surface via the main tape.

7. The medium processing device according to claim 1, wherein the auxiliary tape is respectively provided at least at two locations that sandwich the main tape from both sides thereof in a direction along a rotation axis of the drum.

8. A medium transaction device, comprising:

a receiving section that receives a sheet-form medium, for which a transaction is to be performed, from outside the medium transaction device;

a conveyance section that conveys the medium; and the medium processing device according to claim 1.

* * * * *